US011531283B2

(12) United States Patent
Yamashita et al.

(10) Patent No.: US 11,531,283 B2
(45) Date of Patent: Dec. 20, 2022

(54) WHITE TONER FOR ELECTROSTATIC IMAGE DEVELOPMENT, ELECTROSTATIC IMAGE DEVELOPER, TONER CARTRIDGE, PROCESS CARTRIDGE, IMAGE FORMING APPARATUS, IMAGE FORMING METHOD, TONER SET FOR ELECTROSTATIC IMAGE DEVELOPMENT, AND ELECTROSTATIC IMAGE DEVELOPER SET

(71) Applicant: FUJIFILM Business Innovation Corp., Tokyo (JP)

(72) Inventors: Takahiro Yamashita, Kanagawa (JP); Tsuyoshi Murakami, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/406,255

(22) Filed: Aug. 19, 2021

(65) Prior Publication Data

US 2022/0373908 A1 Nov. 24, 2022

(30) Foreign Application Priority Data

May 24, 2021 (JP) ..... JP2021-087065

(51) Int. Cl.

| | |
|---|---|
| ***G03G 9/087*** | (2006.01) |
| ***G03G 9/08*** | (2006.01) |
| ***G03G 15/08*** | (2006.01) |

(52) U.S. Cl.

CPC ..... *G03G 9/08755* (2013.01); *G03G 9/0819* (2013.01); *G03G 15/0865* (2013.01); *G03G 2215/0604* (2013.01)

(58) Field of Classification Search

CPC ..... G03G 9/08755; G03G 9/819; G03G 15/0865; G03G 2215/0604

See application file for complete search history.

(56) References Cited

U.S. PATENT DOCUMENTS 10,670,983 B2 * 6/2020 Taguchi ..... G03G 9/0827
2006/0257777 A1 * 11/2006 Matsumura ..... G03G 9/08797 430/137.14

(Continued)

FOREIGN PATENT DOCUMENTS

JP 05-107798 A 4/1993
JP 2001255703 A * 9/2001 ..... G03G 9/0804

(Continued)

*Primary Examiner* — Ryan D Walsh
(74) *Attorney, Agent, or Firm* — Sughrue Mion, PLLC

(57) ABSTRACT

A white toner for electrostatic image development contains white toner particles that contain a binder resin and a white pigment and satisfy condition 1 below:

condition 1: a grain size distribution index $GSD_{vL}$ of the white toner particles satisfies formula (1) below, and a ratio of a number of white toner particles having a diameter of 3 μm or less to a total number of white toner particles is 1% by number or more and less than 6% by number:

$$1.2 \leq GSD_{vL}(=D_{84v}/D_{50v}) \leq 1.5 \quad \text{formula (1):}$$

(in formula (1), $D_{84v}$ is a particle diameter at which a cumulative frequency cumulated from a small diameter side in a volume-based particle size distribution is 84%, and $D_{50v}$ is a particle diameter at which the cumulative frequency cumulated from the small diameter side in the volume-based particle size distribution is 50%).

19 Claims, 2 Drawing Sheets

(56) References Cited

U.S. PATENT DOCUMENTS

| | | | | |
|---|---|---|---|---|
| 2007/0020552 | A1* | 1/2007 | Matsumoto | G03G 9/1134<br>430/111.3 |
| 2008/0070142 | A1* | 3/2008 | Furuki | G03G 9/0918<br>430/108.1 |
| 2012/0148948 | A1* | 6/2012 | Ikeda | G03G 9/09<br>430/124.1 |
| 2015/0309440 | A1* | 10/2015 | Ishii | G03G 15/0812<br>399/53 |
| 2019/0196347 | A1* | 6/2019 | Yoshida | G03G 9/08755 |
| 2019/0196351 | A1* | 6/2019 | Noguchi | G03G 9/0821 |

FOREIGN PATENT DOCUMENTS

| | | | | |
|---|---|---|---|---|
| JP | 2002236396 | A | * | 8/2002 |
| JP | 2008020578 | A | * | 1/2008 |
| JP | 2018-049160 | A | | 3/2018 |

* cited by examiner

WHITE TONER FOR ELECTROSTATIC IMAGE DEVELOPMENT, ELECTROSTATIC IMAGE DEVELOPER, TONER CARTRIDGE, PROCESS CARTRIDGE, IMAGE FORMING APPARATUS, IMAGE FORMING METHOD, TONER SET FOR ELECTROSTATIC IMAGE DEVELOPMENT, AND ELECTROSTATIC IMAGE DEVELOPER SET

CROSS-REFERENCE TO RELATED APPLICATIONS

This application is based on and claims priority under 35 USC 119 from Japanese Patent Application No. 2021-087065 filed May 24, 2021.

BACKGROUND

(i) Technical Field

The present disclosure relates to a white toner for electrostatic image development, to an electrostatic image developer, to a toner cartridge, to a process cartridge, to an image forming apparatus, to an image forming method, to a toner set for electrostatic image development, and to an electrostatic image developer set.

(ii) Related Art

One previously known white toner used for electrophotographic image formation includes a binder resin and a white pigment.

When a color image is formed directly on a color recording medium or a transparent recording medium, the color reproducibility in the color image may be poor. For the purpose of improving the color reproducibility in the color image, a white image (generally a white image with a density of 100%, i.e., a solid white image) is in some cases formed as a hiding layer that hides the color of the color recording medium or reduces the transparency of the transparent recording medium. The hiding power of the white image is obtained because light incident on the white image does not pass through the white image but is reflected therefrom. Therefore, some methods for obtaining a white image having good hiding power have been proposed, such as increasing the thickness of the white image, increasing the diameter of white toner particles, and increasing the amount of the white pigment in the white toner.

Japanese Unexamined Patent Application Publication No. 5-107798 discloses a white toner having good hiding power. This white toner contains at least a binder resin and small thermosetting resin particles or small resin particles having a softening point higher than that of the binder resin.

Japanese Unexamined Patent Application Publication No. 2018-049160 discloses a white toner for electrophotography that has a high hiding ratio. This white toner contains a binder resin and rutile-type titanium oxide in an amount of 45 to 75 parts by mass based on 100 parts by mass of the binder resin and has a volume average particle diameter $d_{50}$ of 15 to 25 μm.

SUMMARY

Aspects of non-limiting embodiments of the present disclosure relate to a white toner for electrostatic image development that contains a binder resin and a white pigment, has better hiding power than a white toner for electrostatic image development that contains white toner particles that do not satisfy condition 1 described later, and allows a color image to have good color reproducibility.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a white toner for electrostatic image development containing white toner particles that contain a binder resin and a white pigment and satisfy condition 1 below:

condition 1: a grain size distribution index $GSD_{vL}$ of the white toner particles satisfies formula (1) below, and a ratio of a number of white toner particles having a diameter of 3 μm or less to a total number of white toner particles is 1% by number or more and less than 6% by number:

$$1.2 \leq GSD_{vL} (= D_{84v}/D_{50v}) \leq 1.5 \quad \text{formula (1):}$$

(in formula (1), $D_{84v}$ is a particle diameter at which a cumulative frequency cumulated from a small diameter side in a volume-based particle size distribution is 84%, and $D_{50v}$ is a particle diameter at which the cumulative frequency cumulated from the small diameter side in the volume-based particle size distribution is 50%).

BRIEF DESCRIPTION OF THE DRAWINGS

Exemplary embodiments of the present disclosure will be described in detail based on the following figures, wherein.

DETAILED DESCRIPTION

Figure 1:
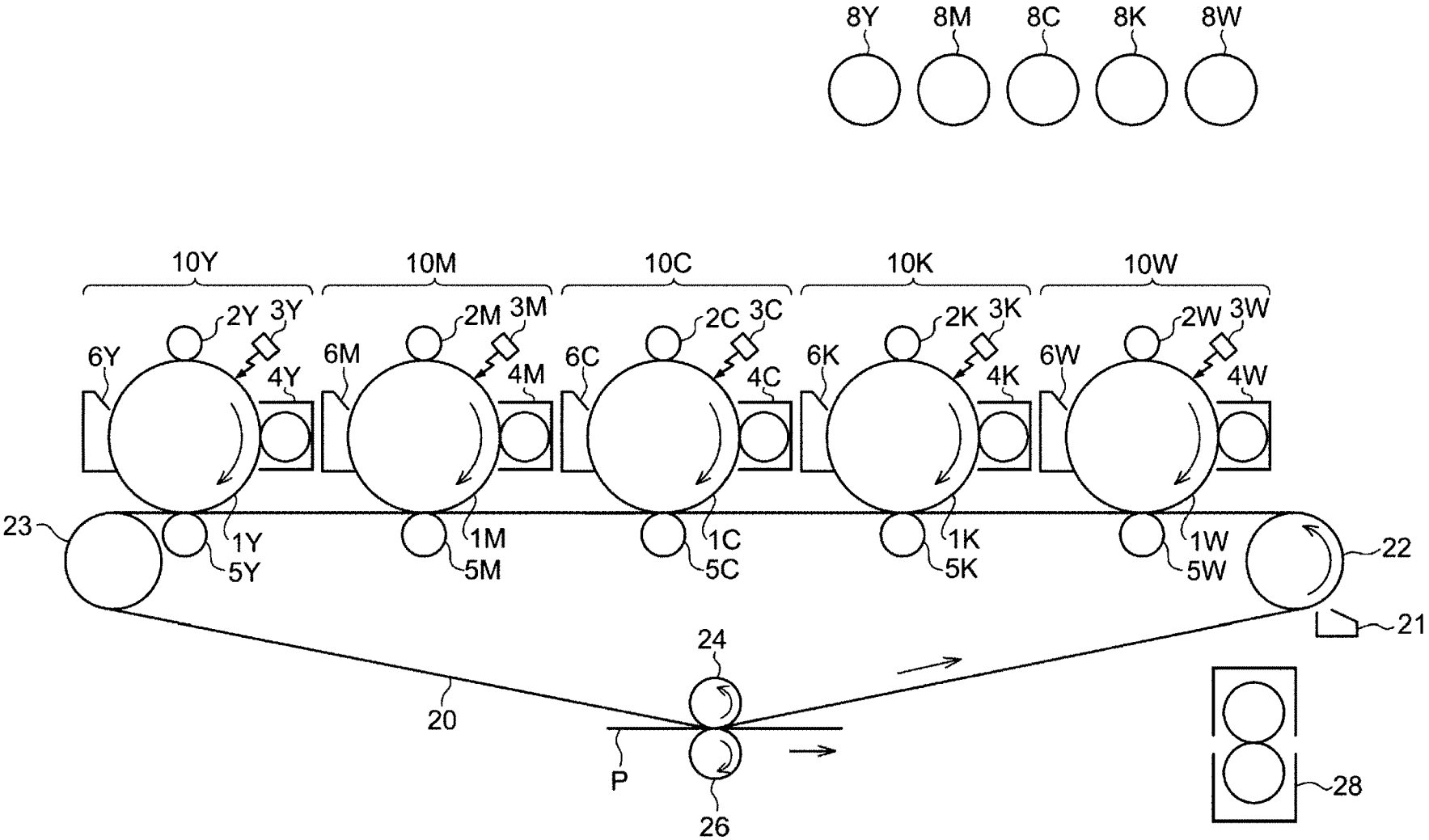
FIG. 1 is a schematic configuration diagram showing an example of an image forming apparatus according to the present disclosure.

Exemplary embodiments of the disclosure will be described below. The description and Examples are illustrative of the exemplary embodiments and are not intended to limit the scope of the disclosure.

In the present disclosure, a numerical range represented using "to" means a range including the numerical values before and after the "to" as the minimum value and the maximum value, respectively.

In a set of numerical ranges expressed in a stepwise manner in the present disclosure, the upper or lower limit in one numerical range may be replaced with the upper or lower limit in another numerical range in the set. Moreover, in a numerical range described in the present disclosure, the upper or lower limit in the numerical range may be replaced with a value indicated in an Example.

In the present disclosure, the term "step" is meant to include not only an independent step but also a step that is not clearly distinguished from other steps, so long as the prescribed purpose of the step can be achieved.

In the present disclosure, when an exemplary embodiment is explained with reference to the drawings, the structure of the exemplary embodiment is not limited to the structure shown in the drawings. In the drawings, the sizes of the components are conceptual, and the relative relations between the components are not limited to these relations.

In the present disclosure, any component may include a plurality of materials corresponding to the component. In the present disclosure, when reference is made to the amount of a component in a composition, if the composition contains a plurality of materials corresponding to the component, the amount means the total amount of the plurality of materials, unless otherwise specified.

In the present disclosure, the term "(meth)acrylic" is meant to include "acrylic" and "methacrylic."

In the present disclosure, "a white toner for electrostatic image development" may be referred to simply as "a white toner," and "a color toner for electrostatic image development" may be referred to simply as "a color toner." "A white electrostatic image developer" may be referred to simply as "a white developer," and "a color electrostatic image developer" may be referred to simply as "a color developer."

In the present disclosure, "a toner set for electrostatic image development" may be referred to simply as "a toner set," and "an electrostatic image developer set" may be referred to simply as "a developer set."

<White Toner for Electrostatic Image Development>

A white toner according to the present disclosure contains white toner particles containing a binder resin and a white pigment and satisfying the following condition 1:

condition 1: the grain size distribution index $GSD_{vL}$ of the white toner particles satisfies formula (1) below, and the ratio of the number of white toner particles having a diameter of 3 μm or less to the total number of white toner particles is from 1% by number to 6% by number inclusive:

$$1.2 \leq GSD_{vL}(=D_{84v}/D_{50v}) \leq 1.5 \quad \text{formula (1):}$$

(in formula (1), $D_{84v}$ is a particle diameter at which the cumulative frequency cumulated from a small diameter side in a volume-based particle size distribution is 84%, and $D_{50v}$ is a particle diameter at which the cumulative frequency cumulated from the small diameter side in the volume-based particle size distribution is 50%).

As described above, the white toner according to the present disclosure contains the white toner particles satisfying condition 1. The white toner particles satisfying condition 1 mean that the particle size distribution is moderately broad on the large diameter side. When the white toner having such a particle size distribution is used to form a white image (referred to also as a hiding layer) that is a layer composed of the white toner, white toner particles on the large diameter side contribute to an increase in TMA (Toner Mass per Area), and spaces between the toner particles are filled with smaller toner particles by utilizing their difference in diameter, so that the uniformity in the height of the white image may be improved. Therefore, the white image obtained using the white toner according to the present disclosure may have high hiding power, and the irregularity of the arrangement of toner particles forming a color image serving as an upper layer may be reduced, so that color reproducibility in the color image may be improved.

The white toner particles satisfy formula (1), and this means that the white toner particles include an appropriate amount of small-diameter toner particles. In this case, an optimal amount of the small-diameter toner particles are contained in the white image serving as the lower image, and the number of contact points between the small-diameter white toner particles in the white image and the color toner particles in the upper color image and their contact area thereby increase, so that the adhesion between the white toner particles and the color toner particles may be increased. Therefore, rolling of the color toner particles in the color image, spattering, etc. may be prevented, and the fixation of the color image is facilitated, so that the color reproducibility in the color image may be improved.

[Condition 1]

Next, condition 1 will be described.

Condition 1 specifies that the grain size distribution index $GSD_{vL}$ of the white toner particles satisfies formula (1) below and the ratio of the number of white toner particles having a diameter of 3 μm or less to the total number of white toner particles is 1% by number or more and less than 6% by number:

$$1.2 \leq GSD_{vL}(=D_{84v}/D_{50v}) \leq 1.5 \quad \text{formula (1):}$$

(in formula (1), $D_{84v}$ is a particle diameter at which the cumulative frequency cumulated from a small diameter side in a volume-based particle size distribution is 84%, and $D_{50v}$ is a particle diameter at which the cumulative frequency cumulated from the small diameter side in the volume-based particle size distribution is 50%).

A method for measuring the diameters of the white toner particles in the present disclosure will be described.

The diameters of the white toner particles are measured using Coulter Multisizer II (manufactured by Beckman Coulter, Inc.), and ISOTON-II (manufactured by Beckman Coulter, Inc.) is used as an electrolyte. In the measurement, 0.5 mg to 50 mg of a measurement sample is added to 2 mL of a 5% by mass aqueous solution of a surfactant (which may be sodium alkylbenzenesulfonate), and the mixture is added to 100 mL to 150 mL of the electrolyte. The electrolyte with the sample suspended therein is subjected to dispersion treatment for 1 minute using an ultrasonic dispersion apparatus, and then the diameters of particles having diameters in the range of 2 μm to 60 μm are measured using an aperture having an aperture diameter of 100 μm in the Coulter Multisizer II. The number of sample particles (i.e., the number of particles) is 50,000. A particle diameter at which the cumulative frequency cumulated from the small diameter side in the measured volume-based particle size distribution is 50% is defined as $D_{50v}$ or a volume average particle diameter $D_{50v}$, and a particle diameter at which the cumulative frequency is 84% is defined as $D_{84v}$.

In the measurement of the physical properties of the toner particles in the toner, when the toner contains an external additive in addition to the toner particles, the toner and a solution mixture of ion exchanged water and a surfactant are subjected to ultrasonic treatment for 20 minutes to remove the external additive, and the measurement is performed after the surfactant has been removed and the toner particles have been dried and collected. The treatment for removing the external additive may be repeatedly performed until the external additive has been completely removed.

The ratio of the number of white toner particles having a diameter of 3 μm or less is determined using the following method.

In the method for measuring the diameters of the white toner particles, the number of sample particles having a diameter of 3 μm or less among the 50,000 sample particles is determined. Then the ratio the number of sample particles having a diameter of 3 μm or less to the 50,000 sample particles is determined and used as the ratio of the number of white toner particles having a diameter of 3 μm or less to the total number of white toner particles.

[Condition 11]

In the present disclosure, from the viewpoint of forming a white image having higher hiding power and allowing a color image to have better color reproducibility, the white toner particles may satisfy the following condition 11.

Condition 11: The grain size distribution index $GSD_{vL}$ of the white toner particles satisfies formula (11) below, and the ratio of the number of white toner particles having a diameter of 3 μm or less to the total number of white toner particles is 1.3% by number or more and less than 5% by number:

$$1.25 \leq GSD_{vL}(=D_{84v}/D_{50v}) \leq 1.40 \quad \text{Formula (11):}$$

(in formula (11), $D_{84v}$ is a particle diameter at which the cumulative frequency cumulated from the small diameter side in the volume-based particle size distribution is 84%, and $D_{50v}$ is a particle diameter at which the cumulative frequency cumulated from the small diameter side in the volume-based particle size distribution is 50%).

In the present disclosure, from the viewpoint of forming a white image having higher hiding power and allowing a color image to have better color reproducibility, the $GSD_{vL}$ ($=D_{84v}/D_{50v}$) of the white toner particles is more preferably from 1.5 to 4 inclusive and still more preferably from 2 to 4 inclusive.

From the viewpoint of forming a white image having higher hiding power and allowing a color image to have better color reproducibility, the ratio of the number of white toner particles having a diameter of 3 μm or less to the total number of white toner particles is more preferably from 1.5% by number to 4% by number inclusive and still more preferably from 1.7% by number to 3% by number inclusive.

The $GSD_{vL}$ of the white toner particles and the ratio of the number of white toner particles having a diameter of 3 μm or less can be adjusted by controlling the rate of stirring and the amount of a surfactant added when the white toner particles are produced using a wet production method (such as an aggregation/coalescence method). By controlling the rate of stirring, the $GSD_{vL}$ can be adjusted. By controlling the amount of the surfactant added, the ratio of the number of white toner particles having a diameter of 3 μm or less can be adjusted. When a dry production method (such as a kneading-grinding method) is used, the $GSD_{vL}$ of the white toner particles and the ratio of the number of white toner particles having a diameter of 3 μm or less can be adjusted by adjusting grinding conditions (such as the air speed in a jet mill) or classifying the toner particles produced and then setting the cutoff conditions for coarse and fine powders (such as the classifying air speed in an elbow jet classifier) to desired values.

Therefore, when a wet production method is used to obtain the white toner particles satisfying condition 1 (preferably condition 11), the rate of stirring and the amount of the surfactant added when the toner particles are produced are adjusted to desired values. When a dry production method is used, the toner particles are subjected to classification. The toner particles obtained by the wet production method may be subjected to classification.

[Volume Average Particle Diameter]

In the present disclosure, the volume average particle diameter (i.e., $D_{50v}$ described above) of the white toner particles is preferably from 5 μm to 10 μm inclusive, more preferably from 6 μm to 9.5 μm inclusive, and still more preferably from 7 μm to 9 μm inclusive.

When the volume average particle diameter of the white toner particles is 5 μm or more, the hiding power tends to increase. When the volume average particle diameter of the white toner particles is 10 μm or less, the color reproducibility in the color image tends to be high.

[Average Circularity]

In the present disclosure, from the viewpoint of improving the hiding power, the average circularity of the white toner particles is preferably from 0.93 to 0.98 inclusive, more preferably from 0.94 to 0.975 inclusive, and still more preferably from 0.95 to 0.97 inclusive.

The circularity of a toner particle is determined as (the peripheral length of an equivalent circle of the toner particle/the peripheral length of the toner particle) (specifically, the peripheral length of a circle having the same area as a projection image of the particle/the peripheral length of the projection image of the particle).

Specifically, the average circularity is a value measured by the following method.

First, the toner particles used for the measurement are collected by suction, and a flattened flow of the particles is formed. Particle images are captured as still images using flashes of light, and the average circularity is determined by subjecting the particle images to image analysis using a flow-type particle image analyzer (FPIA-3000 manufactured by SYSMEX Corporation). The number of sampled particles for the determination of the average circularity is 3,500.

[Condition 2]

In the white toner according to the present disclosure, from the viewpoint of forming a white image having higher hiding power and allowing a color image to exhibit better color reproducibility, the white toner particles may satisfy the following condition 2.

Condition 2: When cross sections of the white toner particles are observed, the number of white pigment grains contained in the white toner satisfies the following formulas (2) and (3):

$$2 \leq Sa \leq 20, \text{ and} \quad \text{formula (2):}$$

$$0.1 \leq Ssd/Sa \leq 0.6 \quad \text{formula (3):}$$

(in formulas (2) and (3), Sa is the average of values obtained by dividing the numbers of white pigment grains contained in the white toner particles by the equivalent circle diameters of the white toner particles, the values being computed for 100 white toner particles, and Ssd is the standard deviation of the values obtained by dividing the numbers of white pigment grains contained in the white toner particles by the equivalent circle diameters of the white toner particles, the values being computed for 100 white toner particles).

Sa in condition 2 above is more preferably from 4 to 18 inclusive and still more preferably from 6 to 16 inclusive.

Ssd/Sa in condition 2 above is more preferably from 0.15 to 0.50 inclusive and still more preferably from 0.2 to 0.4 inclusive.

A method for observing cross sections of the white toner particles in the present exemplary embodiment and a method for determining physical properties based on the observation will be described.

—Production of Observation Sample and Extraction of Observation Cross Sections—

The toner particles (which may contain an external additive adhering thereto) are embedded in a bisphenol A-type liquid epoxy resin using a curing agent to produce a sample to be cut. A cutting machine equipped with a diamond knife (such as LEICA ultramicrotome manufactured by Hitachi High-Technologies Corporation) is used to cut the sample at −100° C. to produce an observation sample. If necessary, the observation sample is left to stand in a ruthenium tetroxide atmosphere in a desiccator to stain the sample.

The thus-obtained observation sample is observed under a scanning transmission electron microscope (STEM), and an STEM image is recorded at a magnification at which a cross section of one toner particle is present in the field of view. The recorded STEM image is subjected to image analysis under the condition of 0.010000 μm/pixel using image analysis software (WinROOF 2015, MITANI CORPORATION), and the cross sectional shape of the toner particle is determined based on the difference in brightness (contrast) between the embedding epoxy resin and the binder resin in the toner particle.

—Number of White Pigment Grains and Equivalent Circle Diameter of White Toner Particle—

The number of white pigment grains contained in the one white toner particle in the STEM image is determined. Then the projection area of the white toner particle used for the determination of the number of white pigment grains is determined using its cross-sectional shape, and the equivalent circle diameter ($=2\sqrt{(\text{area}/\pi)}$) is computed using the determined area.

The above procedure is repeated for 100 white toner particles to compute Sa and Ssd in condition 2 above. Ssd/Sa is a value obtained by dividing the computed Ssd by the computed Sa.

To obtain white toner particles satisfying condition 2 using a wet production method, the rate of stirring when the toner particles are produced and the amount of the surfactant added are adjusted to desired values. When a dry production method is used, the toner particles are subjected to classification. The toner particles obtained by the wet production method may be subjected to classification.

The white toner according to the present disclosure may satisfy the following condition 3. The aerated bulk density ($\rho_A$) of the toner is from 0.3 to 0.6 inclusive, and its packed bulk density ($\rho_P$) is from 0.6 to 0.9 inclusive. Moreover, the compressibility C represented by the following formula is from 0.3 to 0.6 inclusive.

$$C=(\rho_P-\rho_A)/\rho_P$$

The compressibility C of the toner is defined as follows.

1. A sample on a sieve is allowed to free fall under vibrations so as to fill a container, and (the weight of the sample in this state/its volume) is defined as the aerated bulk density $\rho_A$.

2. The sample on the sieve is allowed to free fall using the same procedure as above while the cylindrical container is tapped to increase the filling factor, and (the weight of the sample in this state/its volume) is defined as the packed bulk density $\rho_P$.

3. The compressibility C can be obtained using the computation formula $C=(\rho_P-\rho_A)/\rho_P$.

More specifically, the aerated bulk density $\rho_A$ and the packed bulk density $\rho_P$ are measured as follows. The apparatus used is a powder tester Type PT-D manufactured by Hosokawa Micron Group. The container used is a stainless steel container having an inner diameter of 30 mm and a volume of 25 $cm^3$.

(1) The container is placed, and a funnel is placed above the container. A dial of a vibrator for vibrating the funnel is set to 5, and the toner is allowed to fall into the container until a conical pile of the toner is formed above the container.

(2) The toner is allowed to fall until the conical pile is formed and the toner spills over. When the toner starts spilling over, the inflow of the toner is stopped, and the toner is left to stand for 1 minute.

(3) A flat spatula formed of a nonmagnetic material is used to level the toner along the upper edge of the container in one operation.

(4) The weight is measured, and a value obtained by subtracting the weight of the container is divided by the volume of the container to thereby obtain the aerated bulk density $\rho_A$.

(5) The container containing the toner whose aerated bulk density has been measured is tapped in the measurement apparatus for 180 seconds.

(6) After the tapping, the container is again placed below the funnel, and the toner is allowed to fall into the container from the funnel.

(7) When a conical pile of the toner is formed and the toner starts spilling over, the inflow of the toner is stopped, and the toner is left to stand for 1 minute, as in the measurement of the aerated bulk density. Then the spatula is used to level the toner, and the weight is measured. The weight of the toner in the container is divided by the volume of the container to obtain the packed bulk density $\rho_P$.

The values of the aerated bulk density $\rho_A$ and packed bulk density $\rho_P$ obtained in the manner described above are substituted into the above formula, and the compressibility C is thereby computed.

The structure of the toner according to the present disclosure will next be described in detail.

[White Toner Particles]

The white toner particles contain at least a binder resin and a white pigment and optionally contains a release agent and additional additives.

—Binder Resin—

Examples of the binder resin include: vinyl-based resins composed of homopolymers of monomers such as styrenes (such as styrene, p-chlorostyrene, and α-methylstyrene), (meth)acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene); and vinyl-based resins composed of copolymers of combinations of two or more of the above monomers.

Other examples of the binder resin include: non-vinyl resins such as epoxy resins, polyester resins, polyurethane resins, polyamide resins, cellulose resins, polyether resins, and modified rosins; mixtures of the non-vinyl resins and the above-described vinyl-based resins; and graft polymers obtained by polymerizing a vinyl monomer in the presence of any of these resins.

One of these binder resins may be used alone, or two or more of them may be used in combination.

The binder resin is preferably a styrene acrylic resin or a polyester resin and particularly preferably a styrene acrylic resin.

(1) Styrene Acrylic Resin

The styrene-acrylic resin suitable as the binder resin is a copolymer obtained by copolymerization of at least a styrene-based monomer (a monomer having a styrene skeleton) and a (meth)acrylic-based monomer (a monomer having a (meth)acryloyl group, preferably a monomer having a (meth)acryloyloxy group). The styrene-acrylic resin contains, for example, a copolymer of a styrene-based monomer and any of the above-described (meth)acrylate monomers.

An acrylic resin portion of the styrene-acrylic resin is a partial structure obtained by polymerizing an acrylic-based monomer, a methacrylic-based monomer, or both of them. The term "(meth)acrylic" is intended to encompass both "acrylic" and "methacrylic."

Specific examples of the styrene-based monomer include styrene, alkyl-substituted styrenes (such as α-methylstyrene, 2-methylstyrene, 3-methylstyrene, 4-methylstyrene, 2-ethylstyrene, 3-ethylstyrene, and 4-ethylstyrene), halogen-substituted styrenes (such as 2-chlorostyrene, 3-chlorostyrene, and 4-chlorostyrene), and vinylnaphthalene. One of these styrene-based monomers may be used alone, or two or more of them may be used in combination.

In particular, from the viewpoint of ease of reaction, ease of controlling the reaction, and availability, the styrene-based monomer is preferably styrene.

Specific examples of the (meth)acrylic-based monomer include (meth)acrylic acid and (meth)acrylates. Examples of the (meth)acrylates include alkyl (meth)acrylates (such as methyl (meth)acrylate, ethyl (meth)acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth) acrylate, n-lauryl (meth)acrylate, n-tetradecyl (meth) acrylate, n-hexadecyl (meth) acrylate, n-octadecyl (meth) acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth) acrylate, isoheptyl (meth)acrylate, isooctyl (meth) acrylate, 2-ethylhexyl (meth) acrylate, cyclohexyl (meth) acrylate, and t-butylcyclohexyl (meth) acrylate), aryl (meth)acrylates (such as phenyl (meth)acrylate, biphenyl (meth) acrylate, diphenylethyl (meth) acrylate, t-butylphenyl (meth) acrylate, and terphenyl (meth) acrylate), dimethylaminoethyl (meth) acrylate, diethylaminoethyl (meth) acrylate, methoxyethyl (meth) acrylate, 2-hydroxyethyl (meth)acrylate, β-carboxyethyl (meth)acrylate, and (meth)acrylamide. One of these (meth)acrylic-based monomers may be used alone, or two or more of them may be used in combination.

Among these (meth)acrylic-based monomers, (meth) acrylates having an alkyl group having 2 to 4 carbon atoms (preferably 2 to 10 carbon atoms and more preferably 3 to 8 carbon atoms) are preferred from the viewpoint of increasing the fixability of the toner. In particular, n-butyl (meth) acrylate is preferred, and n-butyl acrylate is particularly preferred.

No particular limitation is imposed on the copolymerization ratio of the styrene-based monomer and the (meth) acrylic-based monomer (mass ratio: styrene-based monomer/(meth)acrylic-based monomer), but the copolymerization ratio may be 85/15 to 60/40.

The styrene-acrylic resin may have a cross-linked structure. Examples of the styrene-acrylic resin having a cross-linked structure include a copolymer of at least a styrene-based monomer, a (meth)acrylic acid-based monomer, and a cross-linkable monomer.

Examples of the cross-linkable monomer include bifunctional and higher functional cross-linking agents.

Examples of the bifunctional cross-linking agents include divinylbenzene, divinylnaphthalene, di(meth)acrylate compounds (such as diethylene glycol di(meth)acrylate, methylenebis(meth)acrylamide, decanediol diacrylate, and glycidyl (meth)acrylate), polyester-type di(meth)acrylate, and 2-([1'-methylpropylideneamino]carboxyamino)ethyl methacrylate.

Examples of the trifunctional or higher functional cross-linking agent include tri(meth)acrylate compounds (such as pentaerythritol tri(meth)acrylate, trimethylolethane tri (meth)acrylate, and trimethylolpropane tri(meth)acrylate), tetra(meth)acrylate compounds (such as pentaerythritol tetra (meth)acrylate and oligoester (meth) acrylate), 2,2-bis(4-methacryloxypolyethoxyphenyl)propane, diallyl phthalate, triallyl cyanurate, triallyl isocyanurate, triallyl trimellitate, and diallyl chlorendate.

From the viewpoint of increasing the fixability of the toner, the cross-linkable monomer is preferably a bifunctional or higher functional (meth)acrylate compound, more preferably a bifunctional (meth)acrylate compound, still more preferably a bifunctional (meth)acrylate compound having an alkylene group having 6 to 20 carbon atoms, and particularly preferably a bifunctional (meth)acrylate compound having a linear alkylene group having 6 to 20 carbon atoms.

No particular limitation is imposed on the copolymerization ratio of the cross-linkable monomer to the total mass of the monomers (mass ratio: cross-linkable monomer/all the monomers), but the copolymerization ratio may be 2/1,000 to 20/1,000.

From the viewpoint of increasing the fixability of the toner, the glass transition temperature (Tg) of the styrene acrylic resin is preferably from 40° C. to 75° C. inclusive and more preferably from 50° C. to 65° C. inclusive.

The glass transition temperature of a resin is determined from a DSC curve obtained by differential scanning calorimetry (DSC). More specifically, the glass transition temperature of the resin is determined from "extrapolated glass transition onset temperature" described in glass transition temperature determination methods in "Testing methods for transition temperatures of plastics" in JIS K7121-1987.

From the viewpoint of the storage stability of the toner, the weight average molecular weight of the styrene acrylic resin is preferably from 5,000 to 200,000 inclusive, more preferably from 10,000 to 100,000 inclusive, and particularly preferably from 20,000 to 80,000 inclusive.

The weight average molecular weight and number average molecular weight of the resin are measured by gel permeation chromatography (GPC). In the molecular weight measurement by GPC, a GPC measurement apparatus HLC-8120GPC manufactured by TOSOH Corporation is used. A TSKgel Super HM-M (15 cm) column manufactured by TOSOH Corporation and a THF solvent are used. The weight average molecular weight and the number average molecular weight are computed from the measurement results using a molecular weight calibration curve produced using monodispersed polystyrene standard samples.

No particular limitation is imposed on the method for producing the styrene acrylic resin, and any of various polymerization methods (such as solution polymerization, precipitation polymerization, suspension polymerization, bulk polymerization, and emulsion polymerization) may be used. A well-known procedure (such as a batch procedure, a semi-continuous procedure, or a continuous procedure) may be used for the polymerization reaction.

(2) Polyester Resin

The polyester resin is, for example, a polycondensation product of a polycarboxylic acid and a polyhydric alcohol.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (such as cyclohexanedicarboxylic acid), aromatic dicarboxylic acids (such as terephthalic acid, isophthalic acid, phthalic acid, and naphthalenedicarboxylic acid), anhydrides thereof, and lower alkyl (e.g., having 1 to 5 carbon atoms) esters thereof.

In particular, the polycarboxylic acid may be, for example, an aromatic dicarboxylic acid.

The polycarboxylic acid used may be a combination of a dicarboxylic acid and a tricarboxylic or higher polycarboxylic acid having a crosslinked or branched structure. Examples of the tricarboxylic or higher polycarboxylic acid include trimellitic acid, pyromellitic acid, anhydrides thereof, and lower alkyl (e.g., having 1 to 5 carbon atoms) esters thereof.

One of these polycarboxylic acids may be used alone, or two or more of them may be used in combination.

Examples of the polyhydric alcohol include aliphatic diols (such as ethylene glycol, diethylene glycol, triethylene glycol, propylene glycol, butanediol, hexanediol, and neopentyl glycol), alicyclic diols (such as cyclohexanediol, cyclohexanedimethanol, and hydrogenated bisphenol A), and aromatic diols (such as an ethylene oxide adduct of bisphenol A and a propylene oxide adduct of bisphenol A). In particular, the polyhydric alcohol is, for example, preferably an aromatic diol or an alicyclic diol and more preferably an aromatic diol.

The polyhydric alcohol used may be a combination of a diol and a trihydric or higher polyhydric alcohol having a crosslinked or branched structure. Examples of the trihydric or higher polyhydric alcohol include glycerin, trimethylolpropane, and pentaerythritol.

One of these polyhydric alcohols may be used alone, or two or more of them may be used in combination.

The glass transition temperature (Tg) of the polyester resin is preferably from 50° C. to 80° C. inclusive and more preferably from 50° C. to 65° C. inclusive.

The weight average molecular weight (Mw) of the polyester resin is preferably from 5000 to 1000000 inclusive and more preferably from 7000 to 500000 inclusive. The number average molecular weight (Mn) of the polyester resin may be from 2000 to 100000 inclusive. The molecular weight distribution Mw/Mn of the polyester resin is preferably from 1.5 to 100 inclusive and more preferably from 2 to 60 inclusive.

The polyester resin is obtained by a well-known production method. Specifically, for example, in one production method, the polymerization temperature is set to from 180° C. to 230° C. inclusive. If necessary, the pressure inside the reaction system is reduced, and the reaction is allowed to proceed while water and alcohol generated during condensation are removed.

When raw material monomers are not dissolved or compatible with each other at the reaction temperature, a high-boiling point solvent serving as a solubilizer may be added to dissolve the monomers. In this case, the polycondensation reaction is performed while the solubilizer is removed by evaporation. When a monomer with poor compatibility is present, the monomer with poor compatibility and an acid or alcohol to be polycondensed with the monomer are condensed in advance, and then the resulting polycondensation product and the main component are subjected to polycondensation.

The content of the binder resin relative to the total mass of the toner particles is preferably from 40% by mass to 95% by mass inclusive, more preferably from 50% by mass to 90% by mass inclusive, and still more preferably from 60% by mass to 85% by mass inclusive.

—White Pigment—

Examples of the white pigment include inorganic pigments and organic pigments.

Specific examples of the white inorganic pigment include heavy calcium carbonate, light calcium carbonate, titanium dioxide, aluminum hydroxide, satin white, talc, calcium sulfate, barium sulfate, zinc oxide, magnesium oxide, magnesium carbonate, amorphous silica, colloidal silica, white carbon, kaolin, calcined kaolin, delaminated kaolin, aluminosilicate, sericite, bentonite, and smectite. Specific examples of the white organic pigment include polystyrene resin particles and a urea-formalin resin particles.

In particular, from the viewpoint of forming a white image having higher hiding power and allowing a color image to exhibit better color reproducibility, the specific gravity of the white pigment is preferably from 2 to 7 inclusive, more preferably from 3 to 6 inclusive, and still more preferably from 4 to 5 inclusive. The white pigment having a specific gravity of from 2 to 7 inclusive may be at least one selected from the group consisting of titanium oxide, silicon dioxide, aluminum oxide, zinc oxide, and zirconium oxide.

The specific gravity of the white pigment is measured using a Le Chatelier specific gravity bottle by a method according to JIS K 0061.

(1) The Le Chatelier specific gravity bottle is charged with 250 mL of ethyl alcohol such that the meniscus is positioned at a scale mark.

(2) The specific gravity bottle is immersed in a constant-temperature water tank, and the position of the meniscus when the liquid temperature reaches 20.0±0.2° C. is accurately read on the scale of the specific gravity bottle (accuracy: 0.0025 mL).

(3) 100 g of a sample is weighed.

(4) The weight sample is placed in the specific gravity bottle, and bubbles are removed.

(5) The specific gravity bottle is immersed in the constant-temperature water tank, and the position of the meniscus when the liquid temperature reaches 20.0±0.2° C. is accurately read on the scale of the specific gravity bottle (accuracy: 0.0025 mL).

(6) The specific gravity is computed using the following formulas.

$$D=W/(L2-L1) \quad \text{Formula:}$$

$$S=D/0.9982 \quad \text{Formula:}$$

In these formulas, D is the density of the sample (g/cm$^3$, 20° C.), and S is the specific gravity of the sample (20° C.). W is the apparent mass (g) of the sample. L1 is the reading of the meniscus (mL, 20° C.) before the sample is placed in the specific gravity bottle, and L2 is the reading of the meniscus (mL, 20° C.) after the sample is placed in the specific gravity bottle. 0.9982 is the density (g/cm$^3$) of water at 20° C.

From the viewpoint of obtaining good hiding power, the white pigment may be titanium oxide. The crystal structure of the titanium oxide may be any of the anatase structure, the rutile structure, and the brookite structure.

The white pigment used may be optionally subjected to surface treatment or may be used in combination with a dispersant.

From the viewpoint of obtaining good hiding power, the volume average diameter of grains of the white pigment is preferably from 150 nm to 900 nm inclusive, more preferably from 180 nm to 800 nm inclusive, and still more preferably from 200 nm to 700 nm inclusive.

The volume average diameter of the white pigment grains can be computed as follows. The white pigment grains are observed under an SEM (Scanning Electron Microscope) device (S-4100 manufactured by Hitachi, Ltd.), and images of the white pigment grains are captured. The images are transferred to an image analysis device (LUZEX III manufactured by NIRECO CORPORATION) and subjected to image analysis. Specifically, the area of each of the grains is measured, and its equivalent circle diameter is computed from the value of the area. For the equivalent circle diameters obtained, the 50% diameter (D50) in the volume-based cumulative frequency is used as the volume average graine diameter of the white pigment. The magnification of the electron microscope is adjusted such that about 10 to 50 white pigment grains are present in the field of view, and observations of a plurality of fields of view are used to determine the equivalent circle diameters of primary particles.

From the viewpoint of obtaining good hiding power, the BET specific surface area of the white pigment is preferably from 6.5 $m^2/g$ to 8.5 $m^2/g$ inclusive, more preferably from 6.8 $m^2/g$ to 8.2 $m^2/g$ inclusive, and still more preferably from 7.0 $m^2/g$ to 8.0 $m^2/g$ inclusive.

The BET specific surface area of the white pigment is determined using the following measurement method.

When the toner particles contain an external additive added thereto, the toner particles are suspended in water with a surfactant added thereto, and ultrasonic waves are applied to the suspension. The resulting suspension is centrifuged to separate the external additive from the toner particles. Then the toner particles are suspended in a solvent (such as tetrahydrofuran) to dissolve the binder resin in the solvent. Then the resulting mixture is subjected to solid-liquid separation by filtration, and the solid is washed with water sufficiently and dried to thereby obtain a powder (i.e., the white pigment). This powder is used as a sample, and the BET specific surface area is measured by a BET multi-point method using nitrogen gas.

One white pigment may be used alone, or two or more white pigments may be used in combination.

The content of the white pigment relative to the total mass of the toner particles is preferably from 15% by mass to 45% by mass inclusive and more preferably from 20% by mass to 40% by mass inclusive.

—Release Agent—

Examples of the release agent include: hydrocarbon-based waxes; natural waxes such as carnauba wax, rice wax, and candelilla wax; synthetic and mineral/petroleum-based waxes such as montan wax; and ester-based waxes such as fatty acid esters and montanic acid esters. However, the release agent is not limited to these waxes.

The melting temperature of the release agent is preferably from 50° C. to 110° C. inclusive and more preferably from 60° C. to 100° C. inclusive. The melting temperature of the release agent is determined using a DSC curve obtained by differential scanning calorimetry (DSC) from "peak melting temperature" described in a melting temperature determination method in "Testing methods for transition temperatures of plastics" in JIS K7121-1987.

The content of the release agent is preferably from 1% by mass to 20% by mass inclusive and more preferably from 5% by mass to 15% by mass inclusive based on the total mass of the toner particles.

—Additional Additives—

Examples of additional additives include well-known additives such as a magnetic material, a charge control agent, and an inorganic powder. These additives are contained in the toner particles as internal additives.

[Characteristics of Toner Particles]

The toner particles may have a single layer structure or may have a so-called core-shell structure including a core (core particle) and a coating layer (shell layer) covering the core. Toner particles having the core-shell structure may each include, for example: a core containing a binder resin and optionally containing a coloring agent and a release agent; and a coating layer containing a binder resin.

When the white toner particles contain a release agent, the exposure ratio of the release agent is preferably 45% or less, more preferably from 0.1% to 30% inclusive, and still more preferably from 0.3% to 15% inclusive.

The exposure ratio of the release agent is a value determined by X-ray photoelectron spectroscopy (XPS) measurement. The XPS measurement device used is JPS-9000MX manufactured by JEOL Ltd., and the measurement is performed using the MgKα line as an X-ray source at an acceleration voltage of 10 kV and an emission current of 30 mA. The amount of the release agent on the toner surface is determined by applying a peak separation method to a C1S spectrum. With the peak separation method, the measured C1S spectrum is separated into peaks of different components using least square curve fitting. Among the separated peaks, the peak derived from the release agent is selected, and its area and the composition ratio are used to compute the exposure ratio. C1S spectra obtained by performing measurement using the release agent only and the binder resin only used for the production of the toner particles are used as the spectra of the components used as the basis of the separation.

More specifically, in the C1S spectrum obtained by the X-ray photoelectron spectroscopy (XPS) measurement, the ratio of the area of the peak derived from the release agent to the total area of the peaks of the binder resin and the release agent present on the surface of the toner particles is determined as the exposure ratio of the release agent.

[External Additive]

Examples of the external additive include inorganic particles. Examples of the inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surfaces of the inorganic particles used as the external additive may be subjected to hydrophobic treatment. The hydrophobic treatment is performed, for example, by immersing the inorganic particles in a hydrophobic treatment agent. No particular limitation is imposed on the hydrophobic treatment agent. Examples of the hydrophobic treatment agent include silane-based coupling agents, silicone oils, titanate-based coupling agents, and aluminum-based coupling agents. One of these hydrophobic treatment agents may be used alone, or two or more of them may be used in combination. The amount of the hydrophobic treatment agent is generally from 1 part by mass to 10 parts by mass inclusive based on 100 parts by mass of the inorganic particles.

Other examples of the external additive include resin particles (particles of resins such as polystyrene, polymethyl methacrylate, and melamine resin) and cleaning activators (such as a metal salt of a higher fatty acid typified by zinc stearate and particles of a fluorine-based high-molecular weight material).

The external additive in the present exemplary embodiment may be inorganic oxide particles. Specifically, the external additive may be particles of titanium oxide ($TiO_2$), silicon dioxide ($SiO_2$), or alumina ($Al_2O_3$).

The inorganic oxide particles used as the external additive may have a spindle shape because such particles are unlikely to be embedded in the toner particles, and a value obtained by dividing the major axis by the minor axis (the major axis/the minor axis) is preferably from 2.5 to 7.0 inclusive, more preferably from 3.0 to 6.5 inclusive, and still more preferably from 3.5 to 6.0 inclusive.

The value of the major axis/the minor axis of each of the spindle-shaped inorganic oxide particles is determined by the following measurement method.

The toner with the inorganic oxide particles externally added thereto is observed under a scanning electron microscope (SEM). Among the particles adhering to the toner particles, at least 200 spindle-shaped particles are extracted. For each of the spindle-shaped particles, straight lines each connecting two points on the contour of the particle are drawn. Among the straight lines drawn, the longest straight line is used as the major axis, and the length of the major axis is used. Moreover, straight lines perpendicular to the major axis are drawn inside the contour of the spindle-shaped particle. Among these straight lines, the longest straight line is used as the minor axis, and the length of the minor axis is used. The major axis, the minor axis, and the major axis/the minor axis are determined for each of the spindle-shaped particles, and the average of at least 200 particles is determined.

The amount of the external additive added externally is preferably from 1 part by mass to 6 parts by mass inclusive and more preferably from 1 part by mass to 4 parts by mass inclusive based on 100 parts by mass of the toner particles.

[Method for Producing Toner]

Next, a method for producing the toner according to the present disclosure will be described.

The toner according to the present disclosure is obtained by producing toner particles and then externally adding the external additive to the toner particles produced.

The toner particles may be produced by a dry production method (such as a kneading-grinding method) or by a wet production method (such as an aggregation/coalescence method, a suspension polymerization method, or a dissolution/suspension method). No particular limitation is imposed on the production method, and any known production method may be used. In particular, the aggregation/coalescence method may be used to obtain the toner particles.

Specifically, when the toner particles are produced, for example, by the aggregation/coalescence method, the toner particles are produced through: the step of preparing a resin particle dispersion in which resin particles used as the binder resin are dispersed (a resin particle dispersion preparing step); the step of aggregating the resin particles (and other optional particles) in the resin particle dispersion (the dispersion may optionally contain an additional particle dispersion mixed therein) to form aggregated particles (an aggregated particle forming step); and the step of heating the aggregated particle dispersion with the aggregated particles dispersed therein to fuse and coalesce the aggregated particles to thereby form the toner particles (a fusion/coalescence step).

The steps in the aggregation/coalescence method will next be described in detail. In the following description, a method for obtaining toner particles containing the release agent will be described, but the release agent is used optionally. Of course, additional additives other than the release agent may be used.

—Resin Particle Dispersion Preparing Step—

The resin particle dispersion in which the resin particles used as the binder resin are dispersed, a white pigment particle dispersion in which the white pigment is dispersed, and a release agent particle dispersion in which release agent particles are dispersed are prepared.

The resin particle dispersion is prepared, for example, by dispersing the resin particles in a dispersion medium using a surfactant.

Examples of the dispersion medium used for the resin particle dispersion include aqueous mediums.

Examples of the aqueous medium include: water such as distilled water and ion exchanged water; and alcohols. One of these may be used alone, or two or more of them may be used in combination.

Examples of the surfactant include: anionic surfactants such as sulfate-based surfactants, sulfonate-based surfactants, phosphate-based surfactants, and soap-based surfactants; cationic surfactants such as amine salt-based surfactants and quaternary ammonium salt-based surfactants; and nonionic surfactants such as polyethylene glycol-based surfactants, alkylphenol ethylene oxide adduct-based surfactants, and polyhydric alcohol-based surfactants. Of these, an anionic surfactant or a cationic surfactant may be used. A nonionic surfactant may be used in combination with the anionic surfactant or the cationic surfactant.

One of these surfactants may be used alone, or two or more of them may be used in combination.

To disperse the resin particles in the dispersion medium, a commonly used dispersing method that uses, for example, a rotary shearing-type homogenizer, a ball mill using media, a sand mill, or a dyno-mill may be used. The resin particles may be dispersed in the dispersion medium by a phase inversion emulsification method, but this depends on the type of resin particles. In the phase inversion emulsification method, the resin to be dispersed is dissolved in a hydrophobic organic solvent that can dissolve the resin, and a base is added to the organic continuous phase (O phase) to neutralize it. Then water (W phase) is added to change the form of the mixture from W/O to O/W, and the resin is thereby dispersed as particles in the aqueous medium.

The volume average particle diameter of the resin particles dispersed in the resin particle dispersion is, for example, preferably from 0.01 μm to 1 μm inclusive, more preferably from 0.08 μm to 0.8 μm inclusive, and still more preferably from 0.1 μm to 0.6 μm inclusive.

The volume average particle diameter of the resin particles is measured as follows. A particle size distribution measured using a laser diffraction particle size measurement apparatus (e.g., LA-700 manufactured by HORIBA Ltd.) is used and divided into different particle diameter ranges (channels), and a cumulative volume distribution computed from the small particle diameter side is determined. The particle diameter at which the volume is 50% relative to the total volume of the particles is defined as the volume average particle diameter $D_{50v}$. The volume average particle diameters of particles in other dispersions are measured in the same manner.

The content of the resin particles contained in the resin particle dispersion is preferably from 5% by mass to 50% by mass inclusive and more preferably from 10% by mass to 40% by mass inclusive.

The release agent particle dispersion is prepared in a similar manner to the resin particle dispersion. Specifically, the descriptions of the dispersion medium for the resin particle dispersion, the dispersing method, the volume average particle diameter of the particles, and the content of the particles are applicable to the release agent particle dispersion.

The white pigment particle dispersion is prepared in a similar manner to the resin particle dispersion. In the preparation of the white pigment particle dispersion, the white pigment particle dispersion may be prepared while edges of the white pigment particles are removed using a dispersion treatment apparatus having high grinding ability.

The volume average particle diameter of the white pigment particles in the white pigment particle dispersion (the diameter is measured using a laser diffraction particle size distribution measurement apparatus) is preferably from 200 nm to 900 nm inclusive, more preferably from 250 nm to 800 nm inclusive, and still more preferably from 300 nm to 700 nm inclusive.

The content of the white pigment particles contained in the white pigment particle dispersion is preferably from 5% by mass to 50% by mass inclusive and more preferably from 10% by mass to 40% by mass inclusive.

—Aggregated Particle Forming Step—

Next, the resin particle dispersion, the white pigment particle dispersion, and the release agent particle dispersion are mixed. Then the resin particles, the white pigment particles, and the release agent particles are hetero-aggregated in the dispersion mixture to form aggregated particles having diameters close to the target diameter of toner particles.

Specifically, for example, a flocculant is added to the dispersion mixture, and the pH of the dispersion mixture is adjusted to acidic (for example, a pH of from 2 to 5 inclusive). Then a dispersion stabilizer is optionally added, and the resulting mixture is heated to a temperature close to the glass transition temperature of the resin particles (specifically, for example, a temperature from the glass transition temperature of the resin particles−30° C. to the glass transition temperature−10° C. inclusive) to aggregate the particles dispersed in the dispersion mixture to thereby form aggregated particles.

In the aggregated particle forming step, the flocculant may be added at room temperature (e.g., 25° C.) while the dispersion mixture is agitated, for example, in a rotary shearing-type homogenizer. Then the pH of the dispersion mixture may be adjusted to acidic (e.g., a pH of from 2 to 5 inclusive), and the dispersion stabilizer may be optionally added. Then the resulting mixture may be heated.

Examples of the flocculant include a surfactant with a polarity opposite to the polarity of the surfactant contained in the dispersion mixture, inorganic metal salts, and divalent or higher polyvalent metal complexes. When a metal complex is used as the flocculant, the amount of the flocculant used may be reduced, and charging characteristics may be improved.

An additive that forms a complex with a metal ion in the flocculant or a similar bond may be used in combination with the flocculant. The additive used may be a chelating agent.

Examples of the inorganic metal salts include: metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent used may be a water-soluble chelating agent. Examples of the chelating agent include: oxycarboxylic acids such as tartaric acid, citric acid, and gluconic acid; and aminocarboxylic acids such as iminodiacetic acid (IDA), nitrilotriacetic acid (NTA), and ethylenediaminetetraacetic acid (EDTA).

The amount of the chelating agent added is, for example, preferably from 0.01 parts by mass to 5.0 parts by mass inclusive and more preferably 0.1 parts by mass or more and less than 3.0 parts by mass based on 100 parts by mass of the resin particles.

—Fusion/Coalescence Step—

Next, the aggregated particle dispersion in which the aggregated particles are dispersed is heated, for example, to a temperature equal to or higher than the glass transition temperature of the resin particles (e.g., a temperature higher by 10° C. to 30° C. than the glass transition temperature of the resin particles) to fuse and coalesce the aggregated particles to thereby form toner particles.

The toner particles are obtained through the above-described steps.

Alternatively, the toner particles may be produced through: the step of, after the preparation of the aggregated particle dispersion containing the aggregated particles dispersed therein, mixing the aggregated particle dispersion with the resin particle dispersion containing the resin particles dispersed therein and then causing the resin particles to adhere to the surface of the aggregated particles to aggregate them to thereby form second aggregated particles; and the step of heating the second aggregated particle dispersion containing the second aggregated particles dispersed therein to fuse and coalesce the second aggregated particles to thereby form toner particles having the core-shell structure.

After completion of the fusion/coalescence step, the toner particles formed in the solution are subjected to a well-known washing step, a solid-liquid separation step, and a drying step to obtain dried toner particles. From the viewpoint of chargeability, the toner particles may be subjected to displacement washing with ion exchanged water sufficiently in the washing step. From the viewpoint of productivity, suction filtration, pressure filtration, etc. may be performed in the solid-liquid separation step. From the viewpoint of productivity, freeze-drying, flash drying, fluidized drying, vibrating fluidized drying, etc. may be performed in the drying step.

The toner according to the present disclosure is produced, for example, by adding the external additive to the dried toner particles obtained and mixing them. The mixing may be performed, for example, using a V blender, a Henschel mixer, a Loedige mixer, etc. If necessary, coarse particles in the toner may be removed using a vibrating sieving machine, an air sieving machine, etc.

<Toner Set for Electrostatic Image Development>

A toner set according to the present disclosure includes the white toner according to the present disclosure and a color toner containing color toner particles other than the white color.

With the toner set according to the present disclosure, the white toner according to the present disclosure is used to form a white image with high hiding power and allowing a color image to exhibit high color reproducibility, so that the color reproducibility in the color image formed by the color toner can be increased.

In the toner set according to the present disclosure, from the viewpoint of further increasing the color reproducibility in the color image, the volume average particle diameter of the color toner particles may be smaller than the volume average particle diameter of the white toner particles.

Moreover, in the toner set according to the present disclosure, from the viewpoint of further increasing the color reproducibility in the color image, the ratio of the volume average particle diameter of the white toner particles to the volume average particle diameter of the color toner particles (the volume average particle diameter of the white toner particles/the volume average particle diameter of the color toner particles) is preferably from 4/15 to 16/3 inclusive, more preferably from 5/12 to 12/3.5 inclusive, and still more preferably from 6/10 to 10/4 inclusive.

The color toner, the color toner particles, the color coloring agent, and the color image mean a toner, toner particles, a coloring agent, an image that have a color other than the white color. Examples of the color toner include color toners such as a yellow (Y) toner, a magenta (M) toner, and a cyan (C) toner and a black (K) toner.

In the toner set according to the present disclosure, a plurality of color toners may be used in combination with the white toner. For example, four color toners including a yellow toner, a magenta toner, a cyan toner, and a black toner may be used in combination with the white toner to form a toner set. In this case, at least one of the color toners may satisfy the conditions described above, and all the color toners used may satisfy the conditions described above.

Each color toner may be the same as the white toner except that a color coloring agent is used instead to the white pigment, and the physical properties and modes of the color toners may be the same as those of the white toner.

Examples of the color coloring agent include: various pigments such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and various dyes such as acridine-based dyes, xanthene-based dyes, azo-based dyes, benzoquinone-based dyes, azine-based dyes, anthraquinone-based dyes, thioindigo-based dyes, dioxazine-based dyes, thiazine-based dyes, azomethine-based dyes, indigo-based dyes, phthalocyanine-based dyes, aniline black-based dyes, polymethine-based dyes, triphenylmethane-based dyes, diphenylmethane-based dyes, and thiazole-based dyes.

One color coloring agent may be used alone, or two or more coloring agents may be used in combination.

The content of the color coloring agent in the color toner particles is preferably from 1% by mass to 30% by mass inclusive and more preferably from 3% by mass to 15% by mass inclusive based on the total mass of the color toner particles.

<White Electrostatic Image Developer>

It is only necessary that a white developer according to the present disclosure contain at least the white toner according to the present disclosure, and the white developer may be a two-component developer containing a mixture of the white toner and a carrier.

Examples of the carrier include: a coated carrier prepared by coating the surface of a core material formed of a magnetic powder with a resin; a magnetic powder-dispersed carrier prepared by dispersing a magnetic powder in a matrix resin; and a resin-impregnated carrier prepared by impregnating a porous magnetic powder with a resin. In each of the magnetic powder-dispersed carrier and the resin-impregnated carrier, the particles forming the carrier may be used as cores, and the cores may be coated with a resin.

Examples of the magnetic powder include: magnetic metal powders such as iron powder, nickel powder, and cobalt powder; and magnetic oxide powders such as ferrite powder and magnetite powder.

Examples of the coating resin and the matrix resin include polyethylene, polypropylene, polystyrene, polyvinyl acetate, polyvinyl alcohol, polyvinyl butyral, polyvinyl chloride, polyvinyl ethers, polyvinyl ketones, vinyl chloride-vinyl acetate copolymers, styrene-acrylate copolymers, straight silicone resins having organosiloxane bonds and modified products thereof, fluorocarbon resins, polyesters, polycarbonates, phenolic resins, and epoxy resins. The coating resin and the matrix resin may contain an additional additive such as electrically conductive particles. Examples of the electrically conductive particles include: particles of metals such as gold, silver, and copper; and particles of carbon black, titanium oxide, zinc oxide, tin oxide, barium sulfate, aluminum borate, and potassium titanate.

To coat the surface of the core material with a resin, the surface of the core material may be coated with a coating layer-forming solution prepared by dissolving the coating resin and various optional additives in an appropriate solvent. No particular limitation is imposed on the solvent, and the solvent may be selected in consideration of the type of resin used, ease of coating, etc. Specific examples of the resin coating method include: an immersion method in which the core material is immersed in the coating layer-forming solution; a spray method in which the coating layer-forming solution is sprayed onto the surface of the core material; a fluidized bed method in which the coating layer-forming solution is sprayed onto the core material floated by the flow of air; and a kneader-coater method in which the core material of the carrier and the coating layer-forming solution are mixed in a kneader coater and then the solvent is removed.

The mixing ratio (mass ratio) of the toner and the carrier in the two-component developer is preferably toner:carrier=1:100 to 30:100 and more preferably 3:100 to 20:100.

<Electrostatic Image Developer Set>

A developer set according to the present disclosure includes the white developer containing the white toner in the toner set according to the present disclosure and a color developer containing the color toner in the toner set according to the present disclosure.

With the developer set according to the present disclosure, the white developer containing the white toner according to the present disclosure is used to form a white image having high hiding power and allowing a color image to exhibit good color reproducibility. Therefore, the color reproducibility in the color image formed using the color developer containing the color toner is increased.

<Image Forming Apparatus and Image Forming Method>

An image forming apparatus and an image forming method according to the present disclosure will be described.

The image forming apparatus according to the present disclosure includes: an image holding member; a charging device that electrostatically charges the surface of the image holding member; an electrostatic image forming device that forms an electrostatic image on the charged surface of the image holding member; a developing device that contains an electrostatic image developer and develops the electrostatic image formed on the surface of the image holding member with the electrostatic image developer to thereby form a toner image; a transferring device that transfers the toner image formed on the surface of the image holding member onto a recording medium; and a fixing device that fixes the toner image transferred onto the recording medium. The electrostatic image developer used is the white electrostatic image developer according to the present disclosure.

In the image forming apparatus according to the present disclosure, an image forming method (an image forming method according to the present disclosure) is performed. The image forming method includes: electrostatically charging the surface of the image holding member; forming an electrostatic image on the charged surface of the image holding member; developing the electrostatic image formed on the surface of the image holding member with the white electrostatic image developer according to the present disclosure to thereby form a toner image; transferring the toner image formed on the surface of the image holding member onto a recording medium; and fixing the toner image transferred onto the surface of the recording medium.

The image forming apparatus according to the present disclosure may be applied to known image forming apparatuses such as: a direct transfer-type apparatus that transfers a toner image formed on the surface of the image holding member directly onto a recording medium; an intermediate transfer-type apparatus that first-transfers a toner image formed on the surface of the image holding member onto the surface of an intermediate transfer body and second-transfers the toner image transferred onto the surface of the intermediate transfer body onto the surface of a recording medium; an apparatus including a cleaning device for cleaning the surface of the image holding member after the transfer of the toner image but before charging; and an apparatus including a charge eliminating device for eliminating charges on the surface of the image holding member after transfer of the toner image but before charging by irradiating the surface of the image holding member with charge eliminating light.

When the image forming apparatus according to the present disclosure is the intermediate transfer-type apparatus, the transferring device includes, for example: an intermediate transfer body having a surface onto which a toner image is to be transferred; a first transferring device for first-transferring a toner image formed on the surface of the image holding member onto the surface of the intermediate transfer body; and a second transferring device for second-transferring the toner image transferred onto the surface of the intermediate transfer body onto the surface of a recording medium.

In the image forming apparatus according to the present disclosure, for example, a portion including the developing device may have a cartridge structure (process cartridge) that is detachably attached to the image forming apparatus. The process cartridge used may be, for example, a process cartridge that houses the electrostatic image developer according to the present disclosure and includes the developing device.

The image forming apparatus according to the present disclosure may be a tandem-type image forming apparatus including an image forming unit for forming a white toner image and at least one image forming unit for forming a color toner image that are arranged in parallel or may be a single-color image forming apparatus for forming only a white image. In the latter case, a white image is formed on a recording medium using the image forming apparatus according to the present disclosure, and a color image is formed on the recording medium using another image forming apparatus.

No particular limitation is imposed on the recording medium on which an image is to be recorded using the image forming apparatus (image forming method) according to the present disclosure, and a well-known recording medium is used. Examples of the recording medium include resin films and sheets and paper sheets. Examples of the application of the resin films and sheets include packages, labels, packaging materials, advertisement media, and transparencies.

Examples of the resin films and sheets include: polyolefin films and sheets such as polyethylene and polypropylene films and sheets; polyester films and sheets such as polyethylene terephthalate and polybutylene terephthalate films and sheets; polyamide films and sheets such as nylon films and sheets; polycarbonate films and sheets; polystyrene films and sheets; modified polystyrene films and sheets; polyvinyl chloride films and sheets; polyvinyl alcohol films and sheets; and polylactic acid films and sheets. These films and sheets may be unstretched films and sheets or may be uniaxially or biaxially stretched films and sheets. The resin films and sheets may be single-layer or multi-layer films and sheets. The resin films and sheets may be films each having a surface coating layer for assisting fixation of the toner or films and sheets subjected to corona treatment, ozone treatment, plasma treatment, flame treatment, glow discharge treatment, etc.

Examples of the stacking order of the recording medium, the color image, and the white image (hiding layer) include the following (a), (b), and (c):

stacking order (a): the transparent recording medium/the color image/the white image (hiding layer) from the side close to the viewer;

stacking order (b): the color image/the transparent recording medium/the white image (hiding layer) from the side close to the viewer; and stacking order (c): the color image/the white image (hiding layer)/the recording medium (which may be transparent or non-transparent).

An example of the image forming apparatus according to the present disclosure will be described, but this is not a limitation. In the following description, major components shown in FIG. 1 will be described, and description of other components will be omitted.

FIG. 1 is a schematic configuration diagram showing the image forming apparatus according to the present disclosure, and the image forming apparatus illustrated is an intermediate transfer-type quintuple tandem image forming apparatus. The image forming apparatus shown in FIG. 1 (i.e., the intermediate transfer-type image forming apparatus including image forming units 10W, 10K, 10C, 10M, and 10Y arranged in the order shown in FIG. 1) is used to form images on a transparent recording medium in the stacking order (a) described above.

The image forming apparatus shown in FIG. 1 includes first to fifth electrophotographic image forming units 10W, 10K, 10C, 10M, and 10Y (image forming devices) that output white (W), black (K), cyan (C), magenta (M), and yellow (Y) images, respectively, based on color-separated image data. These image forming units (hereinafter may be referred to simply as "units") 10W, 10K, 10C, 10M, and 10Y are arranged so as to be spaced apart from each other horizontally by a prescribed distance. These units 10W, 10K, 10C, 10M, and 10Y may each be a process cartridge detachably attached to the image forming apparatus.

An intermediate transfer belt (an example of the intermediate transfer body) 20 is disposed in lower portions of the units 10W, 10K, 10C, 10M, and 10Y so as to pass through these units. The intermediate transfer belt 20 is wound around a driving roller 22, a support roller 23, and a facing roller 24 that are in contact with the inner surface of the intermediate transfer belt 20 and runs in a direction from the first unit 10W toward the fifth unit 10Y. An intermediate transfer body cleaning unit 21 is disposed on the image holding surface side of the intermediate transfer belt 20 so as to be opposed to the driving roller 22.

White, black, cyan, magenta, and yellow toners contained in toner cartridges 8W, 8K, 8C, 8M, and 8Y, respectively, are supplied to developing devices (examples of the developing device) 4W, 4K, 4C, 4M, and 4Y, respectively, of the units 10W, 10K, 10C, 10M, and 10Y.

The first to fifth units 10W, 10K, 10C, 10M, and 10Y have the same structure and operate similarly. Therefore, the first unit 10W that is disposed upstream in the running direction of the intermediate transfer belt and forms a white image will be described as a representative unit.

The first unit 10W includes a photoconductor 1W serving as an image holding member. A charging roller (an example of the charging device) 2W, an exposure unit (an example of the electrostatic image forming device) 3W, a developing unit (an example of the developing device) 4W, a first transfer roller (an example of the first transferring device) 5W, and a photoconductor cleaner (an example of the cleaning device) 6W are disposed around the photoconductor 1Y in this order. The charging roller 2W charges the surface of the photoconductor 1W to a prescribed potential, and the exposure unit 3W exposes the charged surface to a laser beam according to a color-separated image signal to thereby form an electrostatic image. The developing unit 4W supplies a toner to the electrostatic image to develop the electrostatic image, and the first transfer roller 5W transfers the developed toner image onto the intermediate transfer belt 20. The photoconductor cleaner 6W removes the toner remaining on the surface of the photoconductor 1W after the first transfer.

The first transfer roller 5W is disposed on the inner side of the intermediate transfer belt 20 and placed at a position opposed to the photoconductor 1W. Bias power sources (not shown) for applying first transfer biases are connected to the respective first transfer rollers 5W, 5K, 5C, 5M, and 5Y of the units. The bias power sources are controlled by an unillustrated controller to change the values of transfer biases applied to the respective first transfer rollers.

A white image formation operation in the first unit 10W will be described.

First, prior to the operation, the surface of the photoconductor 1W is charged by the charging roller 2W to a potential of −600 V to −800 V.

The photoconductor 1W is formed by stacking a photosensitive layer on a conductive substrate (with a volume resistivity of, for example, $1\times10^{-6}$ Ωcm or less at 20° C.). The photosensitive layer generally has a high resistance (the resistance of a general resin) but has the property that, when irradiated with a laser beam, the specific resistance of a portion irradiated with the laser beam is changed. Therefore, the charged surface of the photoconductor 1W is irradiated with a laser beam from the exposure unit 3W according to white image data sent from an unillustrated controller. An electrostatic image with a white image pattern is thereby formed on the surface of the photoconductor 1W.

The electrostatic image is an image formed on the surface of the photoconductor 1W by charging and is a negative latent image formed as follows. The specific resistance of the irradiated portions of the photosensitive layer irradiated with the laser beam from the exposure unit 3W decreases, and this causes charges on the surface of the photoconductor 1W to flow. However, the charges in portions not irradiated with the laser beam remain present, and the electrostatic image is thereby formed.

The electrostatic image formed on the photoconductor 1W rotates to a prescribed developing position as the photoconductor 1W rotates. Then the electrostatic image on the photoconductor 1W at the developing position is developed and visualized as a toner image by the developing unit 4W.

An electrostatic image developer containing, for example, at least the white toner and the carrier is housed in the developing unit 4W. The whiter toner is agitated in the developing unit 4W and thereby frictionally charged. The charged white toner has a charge with the same polarity (negative polarity) as the charge on the photoconductor 1W and is held on a developer roller (an example of a developer holding member). As the surface of the photoconductor 1W passes through the developing unit 4W, the white toner electrostatically adheres to charge-eliminated latent image portions on the surface of the photoconductor 1W, and the latent image is thereby developed with the white toner. Then the photoconductor 1W with the white toner image formed thereon continues running at a prescribed speed, and the toner image developed on the photoconductor 1W is transported to a prescribed first transfer position.

When the white toner image on the photoconductor 1W is transported to the first transfer position, a first transfer bias is applied to the first transfer roller 5W, and an electrostatic force directed from the photoconductor 1W toward the first transfer roller 5W acts on the toner image, so that the toner image on the photoconductor 1W is transferred onto the intermediate transfer belt 20. The transfer bias applied in this case has a (+) polarity opposite to the (−) polarity of the toner and is controlled to, for example, +10 μA in the first unit 10W by the controller (not shown).

The toner remaining on the photoconductor 1W is removed and collected by the photoconductor cleaner 6W.

The first transfer biases applied to first transfer rollers 5K, 5C, 5M, and 5Y of the second unit 10K and subsequent units are controlled in the same manner as in the first unit.

The intermediate transfer belt 20 with the white toner image transferred thereon in the first unit 10W is sequentially transported through the second to fifth units 10K, 10C, 10M, and 10Y, and toner images of respective colors are superimposed and multi-transferred.

Then the intermediate transfer belt 20 with the five color toner images multi-transferred thereon in the first to fifth units reaches a second transfer unit that is composed of the intermediate transfer belt 20, the facing roller 24 in contact with the inner surface of the intermediate transfer belt, and a second transfer roller (an example of the second transferring device) 26 disposed on the image holding surface side of the intermediate transfer belt 20. A recording paper sheet (an example of the recording medium) P is supplied to a gap between the second transfer roller 26 and the intermediate transfer belt 20 in contact with each other at a prescribed timing through a supply mechanism, and a second transfer bias is applied to the facing roller 24. The transfer bias applied in this case has the same polarity (−) as the polarity (−) of the toner, and an electrostatic force directed from the intermediate transfer belt 20 toward the recording paper sheet P (an example of the recording medium) acts on the toner images, so that the toner images on the intermediate transfer belt 20 are transferred onto the resin sheet P. In this case, the second transfer bias is determined according to a resistance detected by a resistance detection device (not shown) for detecting the resistance of the second transfer unit and is voltage-controlled.

Then the recording paper sheet P is transported to a press contact portion (nip portion) of a pair of fixing rollers in a fixing unit (an example of the fixing device) 28, and the toner images are fixed onto the recording paper sheet P to thereby form a fixed image.

The recording paper sheet P with the color image fixed thereon is transported to an ejection portion, and a series of the color image formation operations is thereby completed.

<Process Cartridge and Toner Cartridge>

A process cartridge according to the present disclosure will be described.

The process cartridge according to the present disclosure includes a developing device that houses the white electrostatic image developer according to the present disclosure and develops an electrostatic image formed on the surface of an image holding member with the white electrostatic image developer to thereby form a toner image. The process cartridge is detachably attached to the image forming apparatus.

The process cartridge according to the present disclosure may have a structure including, in addition to the developing device, at least one optional device selected from other devices such as an image holding member, a charging device, an electrostatic image forming device, and a transferring device.

An example of the process cartridge according to the present disclosure will be described, but this is not a limitation. In the following description, major components shown in FIG. 2 will be described, and description of other components will be omitted.

Figure 2:
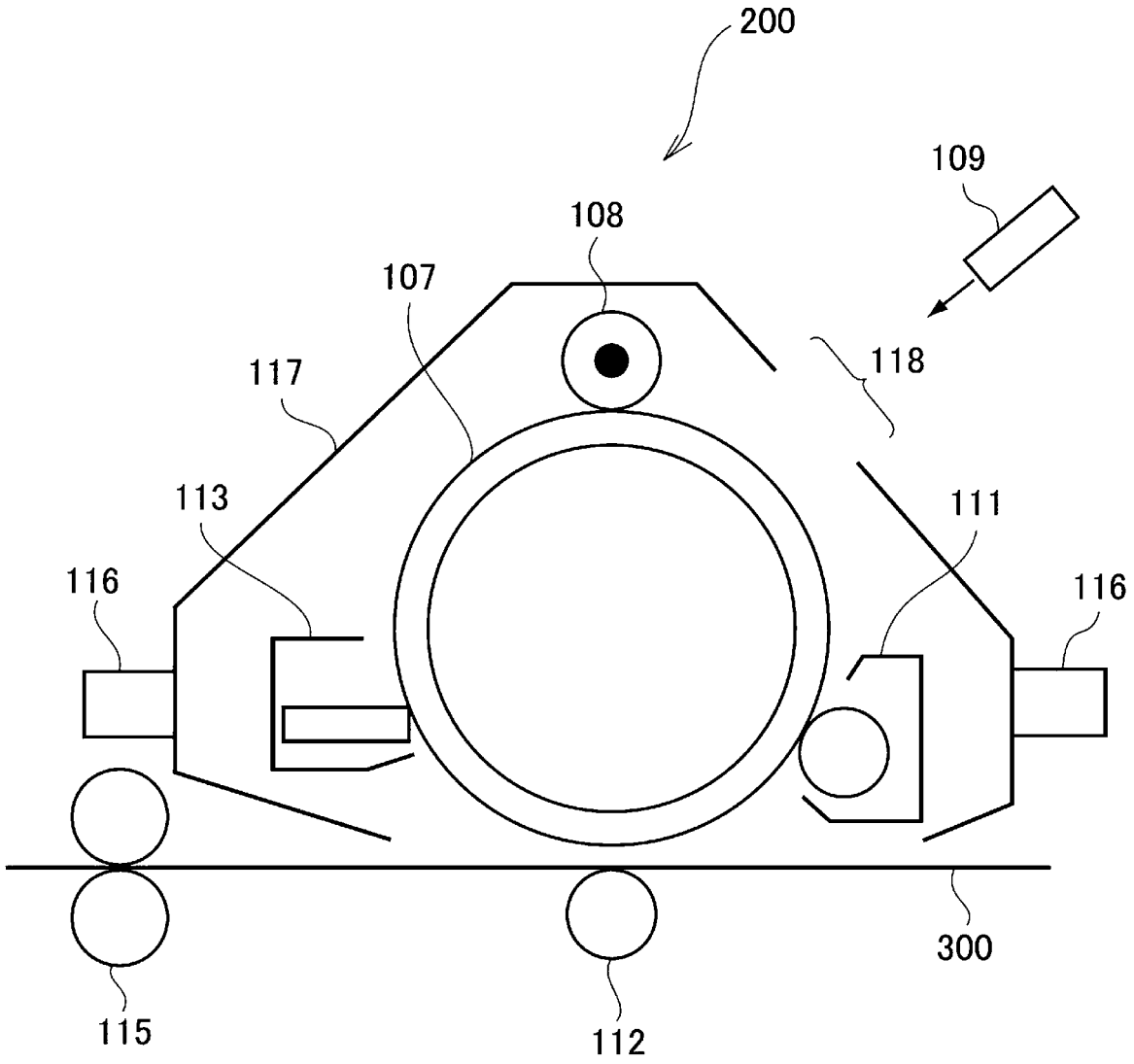
FIG. 2 is a schematic configuration diagram showing an example of a process cartridge according to the present disclosure.

FIG. 2 is a schematic configuration diagram showing the process cartridge according to the present disclosure.

The process cartridge 200 shown in FIG. 2 includes, for example, a housing 117 including mounting rails 116 and an opening 118 for light exposure and further includes a photoconductor 107 (an example of the image holding member), a charging roller 108 (an example of the charging device) disposed on the circumferential surface of the photoconductor 107, a developing unit 111 (an example of the developing device), and a photoconductor cleaner 113 (an example of the cleaning device), which are integrally combined and held in the housing 117 to thereby form a cartridge.

In FIG. 2, 109 denotes an exposure unit (an example of the electrostatic image forming device), and 112 denotes a transferring device (an example of the transferring device). 115 denotes a fixing unit (an example of the fixing device), and 300 denotes a recording paper sheet (an example of the recording medium).

Next, a toner cartridge according to the present disclosure will be described.

The toner cartridge according to the present disclosure houses the white toner according to the present disclosure and is detachably attached to an image forming apparatus. The toner cartridge houses a replenishment toner to be supplied to the developing device disposed in the image forming apparatus.

The image forming apparatus shown in FIG. 1 has a structure in which the toner cartridges 8W, 8K, 8C, 8M, and 8Y are detachably attached, and the developing units 4W, 4K, 4C, 4M, and 4Y are connected to the respective toner cartridges through unillustrated toner supply tubes. When the amount of the toner contained in a toner cartridge is reduced, this toner cartridge is replaced. The toner cartridge 8W is an example of the toner cartridge according to the present disclosure, and the white toner according to the present disclosure is housed in the toner cartridge 8W. A black toner, a cyan toner, a magenta toner, and a yellow toner are housed in the cartridges 8K, 8C, 8M, and 8Y, respectively.

EXAMPLES

The exemplary embodiments of the disclosure will be described in detail by way of Examples. However, the exemplary embodiments of the disclosure are not limited to these Examples. In the following description, "parts" and "%" are based on mass, unless otherwise specified.

<Preparation of Particle Dispersions Etc.>

[Preparation of White Pigment Particle Dispersion (1)]

Titanium oxide particles (product No. KR-380 manufactured by Titan Kogyo, Ltd. titanium): 100 parts Anionic surfactant (Neogen R manufactured by DAI-ICHI KOGYO SEIYAKU Co., Ltd.): 10 parts Ion exchanged water: 150 parts The above materials are mixed in an Iboy wide-mouth bottle 1000 mL (manufactured by AS ONE Corporation, polypropylene), and 300 parts of zirconia beads with a diameter of 3 mm are added to the mixture. The resulting mixture is subjected to rotation treatment at 300 rpm for 24 hours using a ball mill rotation table (manufactured by Asahi Rika Seisakusho K.K.). Then the beads are removed from the dispersion using a stainless steel sieve, and then ion exchanged water was added to thereby obtain a white pigment particle dispersion (1) with a solid content of 40%. The volume average particle diameter of the particles in the white pigment particle dispersion (1) that is measured by a laser diffraction particle size distribution measurement apparatus is 500 nm.

[Preparation of White Pigment Particle Dispersion (2)]

800 Parts of zinc sulfate heptahydrate (zinc grade: 22.3%), 20 parts of aluminum sulfate n-hydrate, and 5 parts of magnesium sulfate heptahydrate are added to 1000 parts of ion exchanged water and dissolved therein to thereby obtain a first aqueous solution. Separately, 500 parts of sodium carbonate is dissolved in 700 parts of pure water to thereby obtain a second aqueous solution. The second aqueous solution is heated and held at 55° C. The first aqueous solution is gradually added dropwise to the second aqueous solution under stirring over 30 minutes. The temperature of the mixture is held at 55° C. After completion of the dropwise addition, the mixture is further stirred for 120 minutes to allow a reaction to proceed. A precipitate is thereby formed in the solution mixture. The precipitate formed is washed with ion exchanged water, and the mixture is subjected to solid-liquid separation to separate the precipitate. The separated precipitate is dried using a freeze dryer for 12 hours and then pulverized using a jet mill to thereby obtain a pulverized product. The pulverized product is fired in a nitrogen gas atmosphere containing 3.5% by volume of water vapor and 2.0% by volume of hydrogen gas at 500° C. for 60 minutes. The fired product obtained is pulverized using a jet mill, and the pulverized product is sieved to remove coarse particles to thereby obtain zinc oxide particles having a volume average particle diameter of 300 nm.

A white pigment particle dispersion (2) is obtained using the same procedure as in the preparation of the white pigment particle dispersion (1) except that the titanium oxide particles are replaced with the zinc oxide particles. The volume average particle diameter of the particles in the white pigment particle dispersion (2) that is measured using a laser diffraction particle size distribution measurement apparatus is 350 nm.

[Preparation of Cyan Color Particle Dispersion (1)]

C.I. Pigment Blue 15:3 (phthalocyanine-based pigment, Cyanine Blue 4937 manufactured by Dainichiseika Color & Chemicals Mfg. Co., Ltd.): 50 parts Ionic surfactant (Neogen RK manufactured by DAI-ICHI KOGYO SEIYAKU Co., Ltd.): 5 parts Ion exchanged water: 192.9 parts The above components are mixed and treated using an Ultimaizer (manufactured by Sugino Machine Limited) at 240 MPa for 10 minutes to thereby prepare a cyan color particle dispersion (1) with a solid content of 20%.

[Preparation of Styrene Acrylic Resin Particle Dispersion (1)]

Styrene: 200 parts
n-Butyl acrylate: 50 parts
Acrylic acid: 1 part
β-Carboxyethyl acrylate: 3 parts
Propanediol diacrylate: 1 part
2-Hydroxyethyl acrylate: 0.5 parts
Dodecanethiol: 1 part A flask is charged with a solution prepared by dissolving 4 parts of an anionic surfactant (Dowfax manufactured by Dow Chemical Company) in 550 parts of ion exchanged water. A solution mixture prepared by mixing the above raw materials is added to the solution, and the resulting mixture is emulsified. While the emulsion is gently stirred for 10 minutes, 50 parts of ion exchanged water containing 6 parts of ammonium persulfate dissolved therein is added to the emulsion. Next, the system is purged with nitrogen sufficiently and heated to 75° C. using an oil bath to allow polymerization to proceed for 30 minutes.

Styrene: 110 parts
n-Butyl acrylate: 50 parts
β-Carboxyethyl acrylate: 5 parts
1,10-Decanediol diacrylate: 2.5 parts
Dodecanethiol: 2 parts Next, a solution mixture prepared by mixing the above raw materials is emulsified, and the emulsion is added to the flask over 120 minutes. Then emulsion polymerization is continued for 4 hours. A resin particle dispersion containing dispersed therein resin particles with a weight average molecular weight of 32,000, a glass transition temperature of 53° C., and a volume average particle diameter of 240 nm is thereby obtained. Ion exchanged water is added to the resin particle dispersion to adjust the solid content to 20% by mass, and the resulting dispersion is used as a styrene acrylic resin particle dispersion (1).

[Preparation of Release Agent Particle Dispersion (1)]

Paraffin wax (HNP 9 manufactured by Nippon Seiro Co., Ltd., melting temperature: 72° C.): 90 parts
Anionic surfactant (Neogen R manufactured by DAI-ICHI KOGYO SEIYAKU Co., Ltd.): 3.6 parts
Ion exchanged water: 360 parts The above materials are mixed and heated to 100° C. to dissolve the wax, and the mixture is subjected to dispersion treatment using a pressure ejection-type Gaulin homogenizer (manufactured by Gaulin Corporation) at a dispersion pressure of 5 MPa for 2 hours and to dispersion treatment at a dispersion pressure of 40 MPa for 3 hours to thereby obtain a release agent particle dispersion (1) with a solid content of 20%. The volume average particle diameter of the particles in the release agent particle dispersion (1) is 230 nm.

[Production of Carrier]

Ferrite particles (volume average particle diameter: 35 μm): 100 parts
Toluene: 14 parts
Styrene/methyl methacrylate copolymer (copolymerization ratio: 15/85): 3 parts
Carbon black (Regal 330 manufactured by Cabot Corporation): 0.2 parts The above materials except for the ferrite particle are dispersed using a sand mill to prepare a dispersion. The dispersion and the ferrite particles are placed in a vacuum degassed-type kneader and dried under reduced pressure while the mixture is stirred to thereby obtain a carrier.

Example 1

<Production of White Toner Particles (1)>

Ion exchanged water: 400 parts
Styrene acrylic resin particle dispersion (1): 200 parts
White pigment particle dispersion (1): 40 parts
Release agent particle dispersion (1): 12 parts
Anionic surfactant (TaycaPower manufactured by TAYCA CORPORATION): 5 parts The above components are placed in a reaction vessel equipped with a thermometer, a pH meter, and a stirrer and held at 30° C. and a stirring speed of 150 rpm for 30 minutes while the temperature of the mixture is controlled from the outside using a heating mantle. While the mixture is dispersed at 5000 rpm for 15 minutes using a homogenizer (ULTRA-TURRAX T50 manufactured by IKA Japan), an aqueous PAC solution prepared by dissolving 2.1 parts of poly-aluminum chloride (PAC manufactured by Oji Paper Co., Ltd.: 30% powder) in 100 parts of ion exchanged water is added to the mixture. Then the resulting mixture is heated to 50° C. under stirring at a stirring rotation speed of 500 rpm, and particle diameters are measured using Coulter Multisizer II (manufactured by Coulter, aperture diameter: 50 μm) to adjust the volume average particle diameter to 5.0 μm. Then 115 parts of the resin particle dispersion (1) is additionally added to cause the resin particles to adhere to the surface of the aggregated particles (to form a shell structure). Next, 20 parts of a 10% aqueous NTA (nitrilotriacetic acid) metal salt solution (Chelest 70 manufactured by Chelest) is added, and the pH of the mixture is adjusted to 9.0 using a 1N aqueous sodium hydroxide solution. Then the resulting mixture is heated to 91° C. at a heating rate of 0.05° C./minute and held at 91° C. for 3 hours to thereby obtain a toner slurry. The toner slurry obtained is cooled to 85° C. and held for 1 hour. Then the slurry is cooled to 25° C. The resulting slutty is re-dispersed in ion exchanged water and filtrated. This procedure is repeated to wash the toner until the electric conductivity of the filtrate reaches 20 μS/cm or less, and the product is vacuum-dried in an oven at 40° C. for 5 hours to thereby obtain white toner particles (1). The volume average particle diameter of the white toner particles (1) is 6.1 μm.

<Production of White Toner (1) and White Developer (1)>

2 Parts of titanium oxide particles (JMT-150FI manufactured by TAYCA CORPORATION) are added to 100 parts of the white toner particles (1), and the mixture is stirred using a Henschel mixer at a stirring peripheral speed of 30 m/second for 15 minutes. Then the mixture is sieved using a vibrating sieve with a mesh size of 45 μm to thereby obtain an external additive-added toner.

The external additive-added toner is observed under a scanning electron microscope (SEM). The external additive has a spindle shape, and the value of the major axis/the minor axis determined by the method described above is 4.5.

10 Parts of the external additive-added toner and 100 parts of the carrier are placed in a V blender and stirred for 20 minutes. Then the mixture is sieved using a sieve with a mesh size of 212 μm to thereby obtain a white developer (1).

Examples 2 to 39 and Comparative Examples 1 to 4

White toner particles in Examples 2 to 39 and Comparative Examples 1 to 4 are obtained using the same procedure as in the production of the white toner particles (1) in Example 1 except that the type of white pigment particle dispersion used and various conditions (such as the stirring rotation speed of the homogenizer, the stirring time, the stirring rotation time during heating, the amount of the anionic surfactant added, and the amount of the polyaluminum chloride added) are appropriately changed.

White toners are produced using the same procedure as in Example 1 except that the white toner particles obtained are used, and then white developers are produced using the same procedure as in Example 1 except that the white toners obtained are used.

<Evaluation of Performance of White Toner>

[Evaluation of Hiding Power]

A solid white image with a toner mass per unit area (TMA) of 15 g/m$^2$ is continuously outputted on transparencies (manufactured by Fuji Xerox Co., Ltd.) at a fixation temperature of 160° C. A black portion of a JIS hiding power measuring paper sheet (manufactured by Motofuji) is placed below the sample image (solid white image) on the 100000th sheet, and the transmission density of the sample image is evaluated using an image densitometer (X-Rite 404A manufactured by X-Rite) according to the criteria below. A 5×5 cm patch is produced as the sample image. The measurement is performed at five points including the center and the four corners, and the average value is used as the transmission density. A transmission density of 2.50 or more is a permissible range.

—Evaluation Criteria—

A: The transmission density is 3.00 or more.

B: The transmission density is 2.70 or more and less than 3.00.

C: The transmission density is 2.50 or more and less than 2.70.

D: The transmission density is 2.00 or more and less than 2.50.

E: The transmission density is less than 2.00.

[Color Reproducibility in Color Image]

A cyan toner (1) and a cyan developer (1) are produced as follows.

<Production of Cyan Toner Particles (1)>

Ion exchanged water: 400 parts

Styrene acrylic resin particle dispersion (1): 200 parts

Cyan color particle dispersion (1): 25 parts

Release agent particle dispersion (1): 12 parts

Anionic surfactant (TaycaPower manufactured by TAYCA CORPORATION): 5 parts

Cyan toner particles (1) are produced using the same procedure as in the method for producing of the white toner particles (1) except that the above components are used. The volume average particle diameter of the cyan toner particles (1) is 5.5 μm.

<Production of Cyan Toner (1) and Cyan Developer (1)>

2 Parts of titanium oxide particles (JMT-150FI manufactured by TAYCA CORPORATION) are added to 100 parts of the cyan toner particles (1), and the mixture is stirred using a Henschel mixer at a stirring peripheral speed of 30 m/second for 15 minutes. Then the mixture is sieved using a vibrating sieve with a mesh size of 45 μm to thereby obtain an external additive-added toner.

10 Parts of the external additive-added toner and 100 parts of the carrier are placed in a V blender and stirred for 20 minutes. Then the mixture is sieved using a sieve with a mesh size of 212 μm to thereby obtain a cyan developer (1).

The cyan toner (1) obtained in the manner described above is used to form a blue image (density: 100%, toner mass per area: 4 g/m$^2$) on a paper sheet (OS coated paper manufactured by Fuji Xerox Co., Ltd., basis weight: 127 g/m$^2$). A spectrophotometer (X-Rite Ci62 manufactured by X-Rite) is used to measure the L* value, the a* value, and the b* value of the blue image under a D50 light source, and the measured values are used as reference values for color reproducibility evaluation.

The cyan toner used above and a white toner in one of the Examples and the Comparative Examples are used to form a stacked image (size: 20.0 cm×28.7 cm) including a blue image (density: 100%, toner mass per area: 4 g/m$^2$) and a white image (density: 100%, toner mass per area: 9 g/m$^2$) stacked together on a transparency (PPC laser-printable transparency manufactured by Fuji Xerox Co., Ltd., size: 21.0 cm×29.7 cm). In the stacked image, the blue image serves as a lower layer (on the transparency side).

The image-formed transparency is wound around a transparent cylindrical body with a diameter of 100 mm so as to be in tight contact therewith such that the white image is on the cylindrical body side, and a spectrophotometer (X-Rite Ci62 manufactured by X-Rite) is used for color measurement. Specifically, the spectrophotometer is used to measure the L* value, the a* value, and the b* value of the blue image from the transparency side under a D50 light source. A color difference ΔE is computed using a formula below and classified into one of A to E below. A color difference ΔE of less than 3.0 is a permissible range.

$$\Delta E=\sqrt{(L_1-L_2)^2+(a_1-a_2)^2+(b_1-b_2)^2}$$

In the above formula, $L_1$, $a_1$, and $b_1$, are the L* value, the a* value, and the b* value, respectively, of the blue image formed on the paper sheet, and $L_2$, $a_2$, and $b_2$ are the L* value, the a* value, and the b* value, respectively, of the blue image formed on the transparency.

A: The color difference ΔE is less than 1.5.

B: The color difference ΔE is 1.5 or more and less than 2.0.

C: The color difference ΔE is 2.0 or more and less than 3.0.

D: The color difference ΔE is 3.0 or more and less than 5.0.

E: The color difference ΔE is 5.0 or more.

TABLE 1

| | White pigment | | Condition 1 | | | | Condition 2 | | Exposure ratio of release agent [%] | Condition 3 | | | Evaluation | |
|---|---|---|---|---|---|---|---|---|---|---|---|---|---|---|
| | Specific gravity | Type | $GSD_{vL}$ | Ratio of white toner particles having diameter of 3 μm or less [% by number] | Volume-based average particle diameter [μm] | Average circularity | Sa | Ssd/Sa | | Aerated bulk density | Packed bulk density | Compressibility C | Hiding power | Color reproducibility |
| Example 1 | 3.7 | Titanium oxide | 1.21 | 2.1 | 6.1 | 0.966 | 2.4 | 0.30 | 0.22 | 0.35 | 0.71 | 0.51 | B | B |
| Example 2 | 3.7 | Titanium oxide | 1.26 | 3.2 | 8.3 | 0.942 | 17.2 | 0.22 | 3.2 | 0.41 | 0.69 | 0.41 | B | A |
| Example 3 | 5.4 | Zinc oxide | 1.33 | 3.9 | 7.7 | 0.958 | 10.8 | 0.38 | 5.8 | 0.52 | 0.81 | 0.36 | B | A |
| Example 4 | 3.7 | Titanium oxide | 1.38 | 3.1 | 9.2 | 0.936 | 5.4 | 0.44 | 10.2 | 0.39 | 0.69 | 0.43 | B | A |
| Example 5 | 3.7 | Titanium oxide | 1.49 | 2.8 | 11.1 | 0.965 | 2.5 | 0.52 | 28.5 | 0.50 | 0.74 | 0.32 | B | B |
| Example 6 | 3.7 | Titanium oxide | 1.28 | 1.1 | 9.4 | 0.955 | 17.5 | 0.36 | 36.5 | 0.48 | 0.68 | 0.29 | B | A |
| Example 7 | 3.7 | Titanium oxide | 1.26 | 1.4 | 6.8 | 0.957 | 10.1 | 0.19 | 13.5 | 0.34 | 0.81 | 0.58 | A | A |
| Example 8 | 3.7 | Titanium oxide | 1.31 | 3.4 | 7.7 | 0.935 | 6.3 | 0.31 | 4.2 | 0.38 | 0.91 | 0.58 | A | A |
| Example 9 | 3.7 | Titanium oxide | 1.27 | 4.8 | 5.8 | 0.967 | 7.4 | 0.30 | 21.9 | 0.42 | 0.68 | 0.38 | A | A |
| Example 10 | 3.7 | Titanium oxide | 1.35 | 5.9 | 5.5 | 0.941 | 14.3 | 0.23 | 3.3 | 0.62 | 0.92 | 0.33 | B | A |
| Example 11 | 3.7 | Titanium oxide | 1.24 | 2.2 | 4.6 | 0.964 | 10.1 | 0.55 | 2.8 | 0.36 | 0.69 | 0.48 | C | B |
| Example 12 | 3.7 | Titanium oxide | 1.38 | 1.6 | 5.1 | 0.940 | 5.8 | 0.33 | 0.9 | 0.51 | 0.77 | 0.34 | B | A |
| Example 13 | 3.7 | Titanium oxide | 1.36 | 3.3 | 11.7 | 0.951 | 2.2 | 0.40 | 0.29 | 0.46 | 0.71 | 0.35 | A | A |
| Example 14 | 3.7 | Titanium oxide | 1.25 | 4.7 | 12.2 | 0.937 | 11.2 | 0.21 | 23.2 | 0.37 | 0.82 | 0.55 | A | C |
| Example 15 | 3.7 | Titanium oxide | 1.22 | 1.8 | 6.2 | 0.927 | 2.8 | 0.35 | 13.4 | 0.35 | 0.73 | 0.52 | B | C |
| Example 16 | 3.7 | Titanium oxide | 1.23 | 2.2 | 8.1 | 0.933 | 15.5 | 0.27 | 40.2 | 0.41 | 0.85 | 0.52 | B | B |
| Example 17 | 3.7 | Titanium oxide | 1.35 | 2.9 | 7.8 | 0.978 | 10.7 | 0.53 | 8.5 | 0.53 | 0.86 | 0.38 | A | A |
| Example 18 | 3.7 | Titanium oxide | 1.22 | 3.6 | 9.3 | 0.985 | 5.3 | 0.39 | 16.5 | 0.31 | 0.69 | 0.55 | B | B |
| Example 19 | 3.7 | Titanium oxide | 1.33 | 1.8 | 11.0 | 0.935 | 1.8 | 0.41 | 32.5 | 0.56 | 0.77 | 0.27 | C | A |
| Example 20 | 3.7 | Titanium oxide | 1.36 | 3.8 | 9.5 | 0.964 | 2.2 | 0.29 | 4.8 | 0.47 | 0.89 | 0.47 | A | B |
| Example 21 | 3.7 | Titanium oxide | 1.31 | 3.5 | 6.9 | 0.941 | 19.7 | 0.52 | 1.2 | 0.39 | 0.81 | 0.52 | A | B |
| Example 22 | 3.7 | Titanium oxide | 1.26 | 3.1 | 7.4 | 0.968 | 20.3 | 0.38 | 3.4 | 0.33 | 0.69 | 0.52 | A | C |
| Example 23 | 3.7 | Titanium oxide | 1.43 | 2.7 | 6.1 | 0.943 | 2.5 | 0.07 | 32.8 | 0.43 | 0.74 | 0.42 | B | B |
| Example 24 | 3.7 | Titanium oxide | 1.22 | 4.5 | 5.4 | 0.958 | 17.1 | 0.12 | 0.59 | 0.38 | 0.85 | 0.55 | A | B |
| Example 25 | 3.7 | Titanium oxide | 1.30 | 2.8 | 6.4 | 0.934 | 10.5 | 0.58 | 4.2 | 0.44 | 0.81 | 0.46 | A | B |
| Example 26 | 3.7 | Titanium oxide | 1.31 | 4.4 | 8.3 | 0.939 | 4.8 | 0.64 | 1.2 | 0.52 | 0.78 | 0.33 | C | B |

TABLE 2

| | White pigment | | Condition 1 | | | | Condition 2 | | Exposure ratio of release agent [%] | Condition 3 | | | Evaluation | |
|---|---|---|---|---|---|---|---|---|---|---|---|---|---|---|
| | Specific gravity | Type | $GSD_{vL}$ | Ratio of white toner particles having diameter of 3 μm or less [% by number] | Volume-based average particle diameter [μm] | Average circularity | Sa | Ssd/Sa | | Aerated bulk density | Packed bulk density | Compressibility C | Hiding power | Color reproducibility |
| Example 27 | 3.7 | Titanium oxide | 1.29 | 4.2 | 7.5 | 0.969 | 2.7 | 0.30 | 0.08 | 0.39 | 0.9 | 0.57 | B | B |
| Example 28 | 3.7 | Titanium oxide | 1.37 | 3.9 | 9.3 | 0.948 | 17.9 | 0.51 | 0.13 | 0.54 | 0.88 | 0.39 | A | A |
| Example 29 | 3.7 | Titanium oxide | 1.22 | 2.2 | 11.1 | 0.957 | 10.3 | 0.24 | 44.6 | 0.48 | 0.71 | 0.32 | B | B |
| Example 30 | 3.7 | Titanium oxide | 1.28 | 3.1 | 9.4 | 0.936 | 2.9 | 0.53 | 45.5 | 0.39 | 0.77 | 0.49 | B | C |
| Example 31 | 3.7 | Titanium oxide | 1.33 | 2.4 | 6.8 | 0.967 | 13.2 | 0.30 | 3.3 | 0.33 | 0.89 | 0.63 | C | B |
| Example 32 | 3.7 | Titanium oxide | 1.35 | 4.1 | 7.7 | 0.942 | 11.8 | 0.41 | 2.8 | 0.45 | 0.65 | 0.31 | A | A |
| Example 33 | 3.7 | Titanium oxide | 1.38 | 3.1 | 5.8 | 0.966 | 5.6 | 0.39 | 0.9 | 0.68 | 0.90 | 0.24 | B | B |
| Example 34 | 3.7 | Titanium oxide | 1.28 | 3.9 | 6.6 | 0.939 | 9.8 | 0.22 | 23.8 | 0.41 | 0.62 | 0.34 | C | B |
| Example 35 | 3.7 | Titanium oxide | 1.39 | 2.7 | 8.1 | 0.944 | 15.2 | 0.49 | 11.3 | 0.39 | 0.78 | 0.50 | A | A |
| Example 36 | 3.7 | Titanium oxide | 1.31 | 2.3 | 7.9 | 0.951 | 13.7 | 0.41 | 7.9 | 0.61 | 0.94 | 0.35 | B | B |
| Example 37 | 3.7 | Titanium oxide | 1.38 | 1.9 | 8.7 | 0.969 | 7.3 | 0.33 | 6.3 | 0.49 | 0.64 | 0.23 | C | B |
| Example 38 | 3.7 | Titanium oxide | 1.29 | 4.4 | 9.3 | 0.955 | 9.9 | 0.29 | 30.1 | 0.38 | 0.69 | 0.45 | A | A |
| Example 39 | 3.7 | Titanium oxide | 1.37 | 3.1 | 5.8 | 0.961 | 5.6 | 0.36 | 0.9 | 0.34 | 0.93 | 0.63 | B | B |
| Comparative Example 1 | 3.7 | Titanium oxide | 1.16 | 1.3 | 6.5 | 0.938 | 2.8 | 0.38 | 0.22 | 0.41 | 0.65 | 0.37 | D | C |

TABLE 2-continued

| | White pigment | | Condition 1 | | | | Condition 2 | | Exposure | Condition 3 | | | Evaluation | |
|---|---|---|---|---|---|---|---|---|---|---|---|---|---|---|
| | Specific gravity | Type | $GSD_{vL}$ | Ratio of white toner particles having diameter of 3 μm or less [% by number] | Volume-based average particle diameter [μm] | Average circularity | Sa | Ssd/Sa | ratio of release agent [%] | Aerated bulk density | Packed bulk density | Compressibility C | Hiding power | Color reproducibility |
| Comparative Example 2 | 3.7 | Titanium oxide | 1.55 | 5.0 | 7.5 | 0.958 | 12.6 | 0.20 | 41.2 | 0.38 | 0.91 | 0.58 | B | E |
| Comparative Example 3 | 3.7 | Titanium oxide | 1.21 | 0.07 | 5.8 | 0.936 | 10.5 | 0.53 | 15.8 | 0.48 | 0.65 | 0.26 | E | B |
| Comparative Example 4 | 3.7 | Titanium oxide | 1.42 | 6.5 | 5.5 | 0.969 | 5.4 | 0.32 | 4.3 | 0.41 | 0.70 | 0.41 | B | D |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A white toner for electrostatic image development, comprising: white toner particles that contain a binder resin and a white pigment and satisfy condition 1 below:

condition 1: a grain size distribution index $GSD_{vL}$ of the white toner particles satisfies formula (1) below, and a ratio of a number of white toner particles having a diameter of 3 μm or less to a total number of white toner particles is 1% by number or more and less than 6% by number:

$$1.2 \leq GSD_{vL}(=D_{84v}/D_{50v}) \leq 1.5 \quad \text{formula (1):}$$

(in formula (1), $D_{84v}$ is a particle diameter at which a cumulative frequency cumulated from a small diameter side in a volume-based particle size distribution is 84%, and $D_{50v}$ is a particle diameter at which the cumulative frequency cumulated from the small diameter side in the volume-based particle size distribution is 50%), wherein the white toner has an aerated bulk density ($\rho_A$) of from 0.3 to 0.7 inclusive, a packed bulk density ($\rho_P$) of from 0.6 to 0.95 inclusive, and a compressibility C of from 0.2 to 0.65 inclusive, the compressibility C being represented by the following formula:

$$C=(\rho_P-\rho_A)/\rho_P.$$

2. The white toner for electrostatic image development according to claim 1, wherein the white toner particles satisfy condition 11 below:

condition 11: the grain size distribution index $GSD_{vL}$ of the white toner particles satisfies formula (11) below, and the ratio of the number of white toner particles having a diameter of 3 μm or less to the total number of white toner particles is 1.3% by number or more and less than 5% by number:

$$1.25 \leq GSD_{vL}(=D_{84v}/D_{50v}) \leq 1.40 \quad \text{Formula (11):}$$

(in formula (11), $D_{84v}$ is a particle diameter at which the cumulative frequency cumulated from the small diameter side in the volume-based particle size distribution is 84%, and $D_{50v}$ is a particle diameter at which the cumulative frequency cumulated from the small diameter side in the volume-based particle size distribution is 50%).

3. The white toner for electrostatic image development according to claim 2, wherein the white toner particles have a volume average particle diameter of from 5 μm to 12 μm inclusive.

4. The white toner for electrostatic image development according to claim 2, wherein the white toner particles have an average circularity of from 0.93 to 0.98 inclusive.

5. The white toner for electrostatic image development according to claim 1, wherein the white toner particles have a volume average particle diameter of from 5 μm to 12 μm inclusive.

6. The white toner for electrostatic image development according to claim 1, wherein the white toner particles have an average circularity of from 0.93 to 0.98 inclusive.

7. The white toner for electrostatic image development according to claim 1, wherein the white pigment has a specific gravity of from 2 to 7 inclusive.

8. The white toner for electrostatic image development according to claim 7, wherein the white pigment having a specific gravity of from 2 to 7 inclusive is at least one selected from the group consisting of titanium oxide, silicon dioxide, aluminum oxide, zinc oxide, and zirconium oxide.

9. The white toner for electrostatic image development according to claim 1, wherein the white toner particles contain a release agent, and wherein an exposure ratio of the release agent is 45% or less.

10. A white electrostatic image developer comprising the white toner for electrostatic image development according to claim 1.

11. A process cartridge to be detachably attached to an image forming apparatus, the process cartridge comprising: a developing device that houses the white electrostatic image developer according to claim 10 and develops, as a toner image, an electrostatic image formed on a surface of an image holding member with the white electrostatic image developer.

12. An image forming apparatus comprising:

an image holding member;

a charging device that electrostatically charges a surface of the image holding member;

an electrostatic image forming device that forms an electrostatic image on the charged surface of the image holding member;

a developing device that houses the white electrostatic image developer according to claim 10 and develops, as a toner image, the electrostatic image formed on the surface of the image holding member with the white electrostatic image developer;

a transfer device that transfers the toner image formed on the surface of the image holding member onto a surface of a recording medium; and a fixing device that fixes the toner image transferred onto the surface of the recording medium.

13. An image forming method comprising:

electrostatically charging a surface of an image holding member;

forming an electrostatic image on the charged surface of the image holding member;

developing, as a toner image, the electrostatic image formed on the surface of the image holding member with the white electrostatic image developer according to claim 10;

transferring the toner image formed on the surface of the image holding member onto a surface of a recording medium; and fixing the toner image transferred onto the surface of the recording medium.

14. A toner cartridge to be detachably attached to an image forming apparatus, wherein the toner cartridge houses the white toner for electrostatic image development according to claim 1.

15. A toner set for electrostatic image development, comprising:

the white toner for electrostatic image development according to claim 1; and a color toner for electrostatic image development containing color toner particles of a color different from the color of the white toner particles.

16. The toner set for electrostatic image development according to claim 15, wherein the volume average particle diameter of the color toner particles is smaller than the volume average particle diameter of the white toner particles.

17. The toner set for electrostatic image development according to claim 15, wherein the ratio of the volume average particle diameter of the white toner particles to the volume average particle diameter of the color toner particles (the volume average particle diameter of the white toner particles/the volume average particle diameter of the color toner particles) is from 4/15 to 16/3 inclusive.

18. An electrostatic image developer set comprising:

a white electrostatic image developer containing the white toner for electrostatic image development and a color electrostatic image developer containing the color toner for electrostatic image development in the toner set for electrostatic image development according to claim 15.

19. A white toner for electrostatic image development, comprising: white toner particles that contain a binder resin and a white pigment and satisfy condition 1 below:

condition 1: a grain size distribution index $GSD_{vL}$ of the white toner particles satisfies formula (1) below, and a ratio of a number of white toner particles having a diameter of 3 μm or less to a total number of white toner particles is 1% by number or more and less than 6% by number:

$$1.2 \leq GSD_{vL}(=D_{84v}/D_{50v}) \leq 1.5 \quad \text{formula (1):}$$

in formula (1), $D_{84v}$ is a particle diameter at which a cumulative frequency cumulated from a small diameter side in a volume-based particle size distribution is 84%, and $D_{50v}$ is a particle diameter at which the cumulative frequency cumulated from the small diameter side in the volume-based particle size distribution is 50%), wherein the white toner particles satisfy condition 2 below:

condition 2: when cross sections of the white toner particles are observed, the number of white pigment grains contained in the white toner satisfies the following formulas (2) and (3):

$$2 \leq Sa \leq 20, \text{ and} \quad \text{formula (2):}$$

$$0.1 \leq Ssd/Sa \leq 0.6 \quad \text{formula (3):}$$

(in formulas (2) and (3), Sa is the average of values obtained by dividing the numbers of white pigment grains contained in the white toner particles by the equivalent circle diameters of the white toner particles, the values being computed for 100 white toner particles, and Ssd is the standard deviation of the values obtained by dividing the numbers of white pigment grains contained in the white toner particles by the equivalent circle diameters of the white toner particles, the values being computed for 100 white toner particles).

* * * * *